US011532317B2

(12) United States Patent
Fitzgerald

(10) Patent No.: US 11,532,317 B2
(45) Date of Patent: Dec. 20, 2022

(54) AUDIO INTERACTIVE DECOMPOSITION EDITOR METHOD AND SYSTEM

(71) Applicant: MUNSTER TECHNOLOGICAL UNIVERSITY, Cork (IE)

(72) Inventor: Derry Fitzgerald, County Cork (IE)

(73) Assignee: MUNSTER TECHNOLOGICAL UNIVERSITY, Cork (IE)

( * ) Notice: Subject to any disclaimer, the term of this patent is extended or adjusted under 35 U.S.C. 154(b) by 97 days.

(21) Appl. No.: 17/126,213

(22) Filed: Dec. 18, 2020

(65) Prior Publication Data

US 2021/0193164 A1 Jun. 24, 2021

Related U.S. Application Data

(60) Provisional application No. 62/949,662, filed on Dec. 18, 2019.

(51) Int. Cl.
*G10L 21/0272* (2013.01)

(52) U.S. Cl.
CPC ..... *G10L 21/0272* (2013.01)

(58) Field of Classification Search
CPC ..... G06F 3/16; G06F 3/165; G11B 20/10527; G11B 27/105; H04N 21/439; H04R 3/12; H04R 2227/003; H04R 2227/005; G10L 21/0272
See application file for complete search history.

(56) References Cited

U.S. PATENT DOCUMENTS

2008/0134866 A1* 6/2008 Brown ..... G10H 1/365 84/661
2011/0046759 A1* 2/2011 Kim ..... G10L 21/0272 700/94

(Continued)

OTHER PUBLICATIONS

Liutkus et al., Kernel Additive Models for Source Separation, Aug. 2014, IEEE Transactions on Signal Processing, vol. 62, No. 16, pp. 4298-4309 (Year: 2014).*

(Continued)

*Primary Examiner* — Fan S Tsang
*Assistant Examiner* — David Siegel
(74) *Attorney, Agent, or Firm* — Arc IP Law, PC; Joseph J. Mayo

(57) ABSTRACT

A distributed system and a corresponding data processing method are disclosed, for decomposing audio signals including mixed audio sources. The system comprises at least one client terminal, a remote queuing module and at least one remote audio data processing module connected in a network. A client terminal stores source audio signal data, selects at least one signal decomposition type, uploads source audio signal data with data representative of the decomposition type selection to the queuing module, and downloads decomposed audio signal data. The queuing module queues uploaded source audio data and distributes same to data processing module(s). The queuing module also queues uploaded decomposed audio signal data and distributes same to client terminal(s). An audio data processing module processes distributed source audio data into decomposed audio signal data according to the type selection, and uploads decomposed audio signal data to the at least one remote queuing resource.

13 Claims, 12 Drawing Sheets

(56) References Cited

U.S. PATENT DOCUMENTS

2013/0152767 A1* 6/2013 Katz ..... A63F 13/10
84/616
2017/0236531 A1* 8/2017 Koretzky ..... G10L 21/0272
381/17

OTHER PUBLICATIONS

Paris Smaragdis et al "Static and Dynamic Source Separation Using Nonnegative Factorizations: A unified view", IEEE Signal Processing Magazine, vol. 31, Issue: 3, May 2014, pp. 66-75.
Emmanuel Vincent et al in "From Blind to Guided Audio Source Separation: How models and side information can improve the separation of sound", IEEE Signal Processing Magazine, vol. 31, Issue: 3, May 2014, pp. 107-115.
Antoine Liutkus et al in "Kernel Additive Models for Source Separation", IEEE Transactions on Signal Processing, vol. 62, No. 16, Aug. 2014 (15 pages).

* cited by examiner

AUDIO INTERACTIVE DECOMPOSITION EDITOR METHOD AND SYSTEM

The application claims the benefit of U.S. Provisional Patent Application No. 62/949,662, filed 18 Dec. 2019, the specification of which is hereby incorporated herein by reference.

BACKGROUND OF THE INVENTION

Field of the Invention

The present invention relates to a distributed method and system for decomposing digital audio signals incorporating multiple audio sources into audio signals incorporating more discrete audio sources.

Description of Related Art

The combination of computing resources evolving according to Moore's Law, with the development and optimisation of algorithms embodied as image data processing techniques, has seen a revolution in the ability to manipulate digital image and video content, with considerable impact across a broad range of applications and user groups, from hobbyists to media production houses and the movie and broadcast industries. This revolution has generated unprecedented creative opportunities for those working with image and video, enhancing their respective creative workflows through the provision of suites of image and video data processing tools. This is perhaps best evidenced, albeit anecdotally, as the common knowledge, and use, by the non-specialist public of image data editing applications such as Adobe® Photoshop®.

By contrast, advances in the field of audio signal editing have been relatively minor. One of the main limitations of existing audio data editing applications is their restricted capacities as regards decomposing an audio signal that has been mixed from several underlying audio components or sources. While recent audio editors have introduced enhanced manipulation capabilities, such as the ability to edit audio spectrograms, they still do not offer the ability to accurately and effectively decompose a mixed audio signal automatically, in a manner analogous to the decomposition of an image by image data editing software. For example, it is relatively easy for a novice user to extract a person from a background in a photograph and to composite the extracted person into a new background, because the state of the art in image data processing algorithms that underlie such extraction and compositing functions permits substantial automation of these tasks, with limited user input if any. Extracting a pitched instrument from a recording of an orchestral performance, such as trumpet, still cannot be done in the same manner.

The majority of research into the decomposition of audio signals in a perceptually meaningful manner, has taken place in the context of sound source separation (SSS). In any recorded audio signal, sound sources can include any one or more of the human voice, environmental noises such as crowd noise, gunshot noise or car noise, and both pitched and unpitched musical instruments such as guitar, violin, drums and more. The sound source separation (SSS) problem can thus be defined as, given a recording containing a mixture of different sound sources, such as a conversation recorded in a busy environment containing multiple speakers, or a recording such as a popular music track with vocals, how to extract one or more individual sources from that mixture.

Audio recordings are typically available as stereo or mono signals, thus there are usually many more sources present than mixtures available. The SSS problem is thus an underdetermined problem, wherein no exact solution is possible. Accordingly, methods for attempting SSS have focused on model-based methods, taking advantage of properties of the signals to be separated, as well as prior knowledge of the sources to be separated.

An extensive amount of research has been published on the topic of sound source separation, much of it focusing on techniques based on non-negative matrix factorisation (NMF) and its variants, as well as Bayesian statistical signal processing, for instance by Paris Smaragdis et al "*Static and Dynamic Source Separation Using Nonnegative Factorizations: A unified view*", IEEE Signal Processing Magazine, Volume: 31, Issue: 3, May 2014, pp 66-75 and by Emmanuel Vincent et al in "*From Blind to Guided Audio Source Separation: How models and side information can improve the separation of sound*", IEEE Signal Processing Magazine, Volume: 31, Issue: 3, May 2014, pp 107-115. Such approaches perform a parts-based decomposition on the audio signal, wherein the parts typically correspond to notes or chords played by an instrument, or to drums. The parts belonging to each instrument must be grouped together for performing separation, and solutions have thus focused on incorporating constraints into the NMF or Bayesian statistical signal processing framework for enabling this grouping.

Other approaches have focused upon exploiting regularities in the sound sources to be decomposed, such as spatial position and repetition or regularity in time and/or frequency. Corresponding algorithms have attempted to separate the sources without resorting to the use of a parts-based representation, and were very successful in specific tasks such as drum sound separation and vocal separation. It was recently observed that the bulk of these algorithms were special cases of a more general framework for designing sound source separation algorithms, termed Kernel Additive Modelling (KAM) by Antoine Liutkus et al in "*Kernel Additive Models for Source Separation*", IEEE Transactions on Signal Processing, Vol 62, No. 16, August 2014.

A number of data processing applications are accordingly known, which embody some of the above-described techniques and allow their user to perform spectral editing. These applications typically require non-trivial data processing resources, in particular high-load, high-performance processors and significant amounts of memory, due to the volume and complexity of calculations to perform upon audio data according to the above-described techniques.

These applications also typically include functionally-comparable audio signal processing algorithms, embodied as tools such as a "magic wand" which highlights the loudest contiguous region under a mouse pointer hovering above a spectrogram rendered in a user interface; a "harmonic magic wand" which harmonically selects related regions of the largest contiguous region under the mouse pointer; and other tools such as "rectangular region selection", "erasers" and more. Some of these applications also operate using a layers-based paradigm, where changes or selections can be removed from an original audio signal to create a new audio track, which in turn can be further edited. Of such software applications, a product marketed by Audionamix® is known to offer automated sound source separation for a vocal monophonic source and drum separation.

An improved method of decomposing audio signals incorporating multiple audio sources, and a system embodying this method, are desirable for mitigating at least some of the above shortcomings of the known prior art.

BRIEF SUMMARY OF THE INVENTION

The present invention provides, as set out in the appended claims, a distributed method and system for decomposing audio signals incorporating multiple audio sources into audio signals incorporating discrete audio sources, wherein the decomposition is performed automatically in respect of at least some of the audio sources. Techniques introduced in the method and system of the invention involve both NMF and KAM signal processing frameworks adapted with constraints and optimisations to improve separation quality.

According to an aspect of the present invention, there is therefore provided a distributed system for decomposing audio signals including mixed audio sources, comprising at least one client terminal, a remote queuing module and at least one remote audio data processing module connected in a network, wherein each client terminal is programmed to store source audio signal data, select at least one signal decomposition type, upload source audio signal data with data representative of the decomposition type selection to the queuing module, and download decomposed audio signal data; each queuing module is programmed to queue uploaded source audio data and distribute same to one or more audio data processing modules and to queue uploaded decomposed audio signal data and distribute same to the or each client terminal; and each audio data processing module is programmed to process distributed source audio data into decomposed audio signal data according to the type selection, and upload decomposed audio signal data to the at least one remote queuing module.

In an embodiment of the system, the decomposition type preferably comprises at least one selected from a vocal audio source separation and a drums audio source separation. In an alternative embodiment, a further pan separation may be selectable, which decomposes the source audio signal according to the location of audio sources therein.

Upon a selection of a vocal audio source separation, each audio data processing module preferably processes distributed source audio data for separating at least the vocal audio source therefrom, with a first sequence of algorithms implementing non-negative matrix factorisations. Each client terminal may be further programmed to constrain one or more algorithms of the first sequence with respective variables encoded in the data representative of the decomposition type selection.

Alternatively, upon a selection of a drums audio source separation, each audio data processing module preferably processes distributed source audio data for separating at least the drums audio source therefrom, with a second sequence of algorithms implementing non-negative matrix factorisations. In an alternative embodiment of this system, at least one algorithm of the second sequence may implement a Kernel Additive Modelling technique for processing the distributed source audio data.

In an embodiment of the system, each client terminal may be further programmed to locally process stored source audio signal data with one or more locally-stored decomposition algorithms into edited audio signal data. Usefully this variant allows some of the less computationally-expensive algorithms to be processed locally, independently of connectivity to the queuing module and by way of preview for the user. A particularly useful embodiment of this variant may implement the at least one KAM algorithm of the second sequence associated with drums track decomposition as a locally-stored decomposition algorithm.

In an embodiment of the system, each client terminal may be further programmed to combine any one or more of stored source audio signal data, downloaded decomposed audio signal data and edited audio signal data $_{-N}$ into a new audio signal $_{N+}$.

According to another aspect of the present invention, there is also provided a computer-implemented method for decomposing a digital audio signal including mixed audio sources in a network, comprising the steps of selecting a source audio signal data and a decomposition type at a client terminal; uploading the source audio signal data and data representative of the selected decomposition type to a queuing module; queuing the uploaded source audio data, and distributing same to an audio data processing module from the queuing module; processing the distributed source audio data into decomposed audio signal data at the audio data processing modules with a sequence of algorithms implementing non-negative matrix factorisations, wherein the sequence is determined by the type selection data; uploading the decomposed audio signal data to the queuing module; and queuing the uploaded decomposed data and distributing same to the client terminal from the queuing module.

In an embodiment of the method, the step of selecting a decomposition type preferably comprises selecting at least one selected from a vocal audio source separation and a drums audio source separation.

Upon a selection of a vocal audio source separation, the step of processing the distributed source audio data may comprise separating at least a vocal audio source therefrom, with a first sequence of algorithms implementing non-negative matrix factorisations. Alternatively, upon a selection of a drums audio source separation, the step of processing the distributed source audio data may comprise separating at least a drums audio source therefrom, with a second sequence—of algorithms implementing non-negative matrix factorisations.

According to a further aspect of the present invention, there is also provided a set of instructions recorded on a data carrying medium or stored at a network storage medium which, when read and processed by a data processing terminal connected to a network, configures the terminal to perform the steps of embodiments of the method as described herein.

Other aspects are as set out in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

1, including a processor and memory means storing a server set of data processing instructions.

Figure 1:
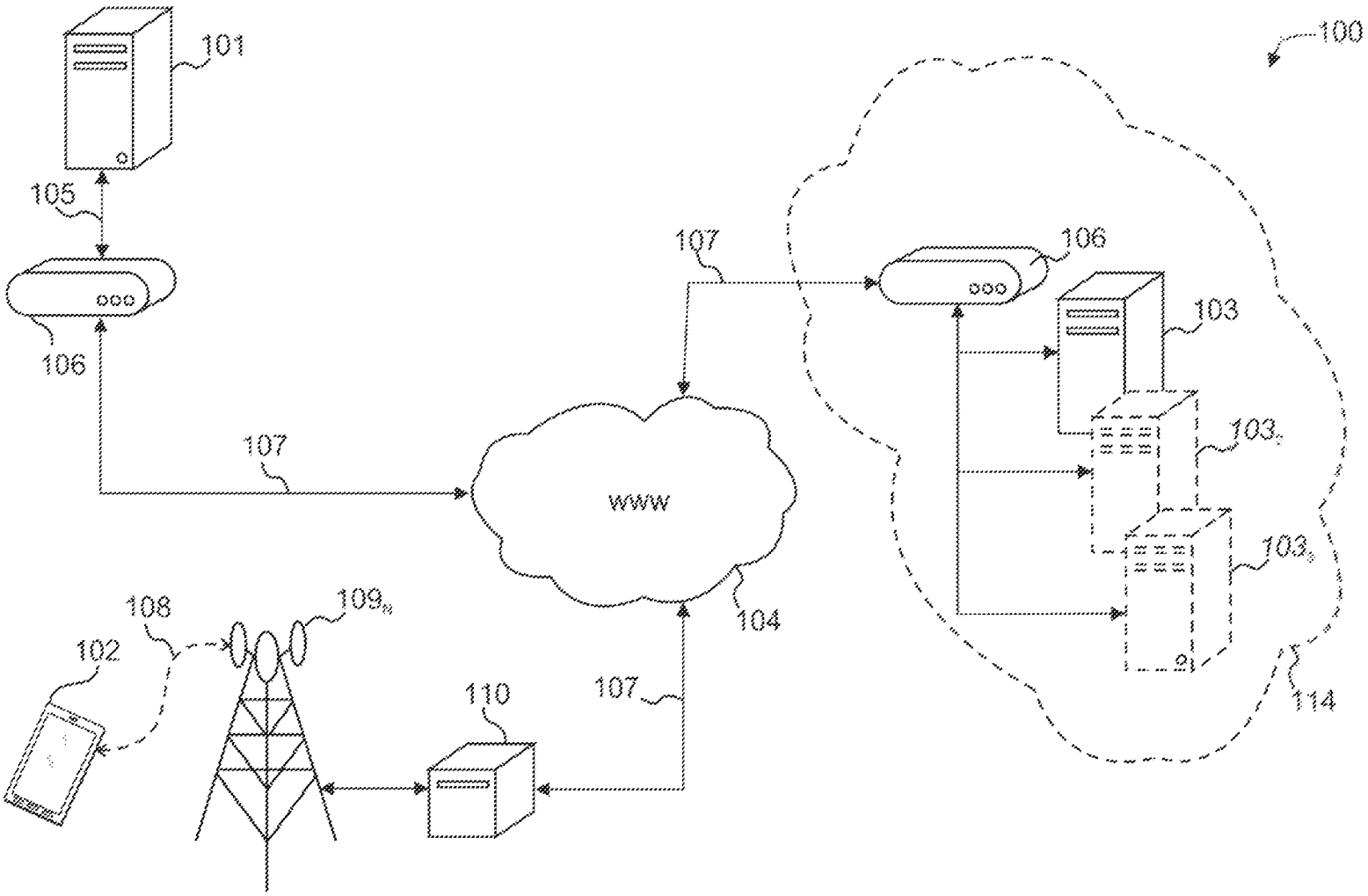
FIG. 1 is a hardware diagram of an embodiment of a system according to the invention, within a network environment comprising a plurality of data processing terminals remote from each other and in data communication with each other, wherein the system comprises a client terminal and instances of a server terminal.
Figure 2:
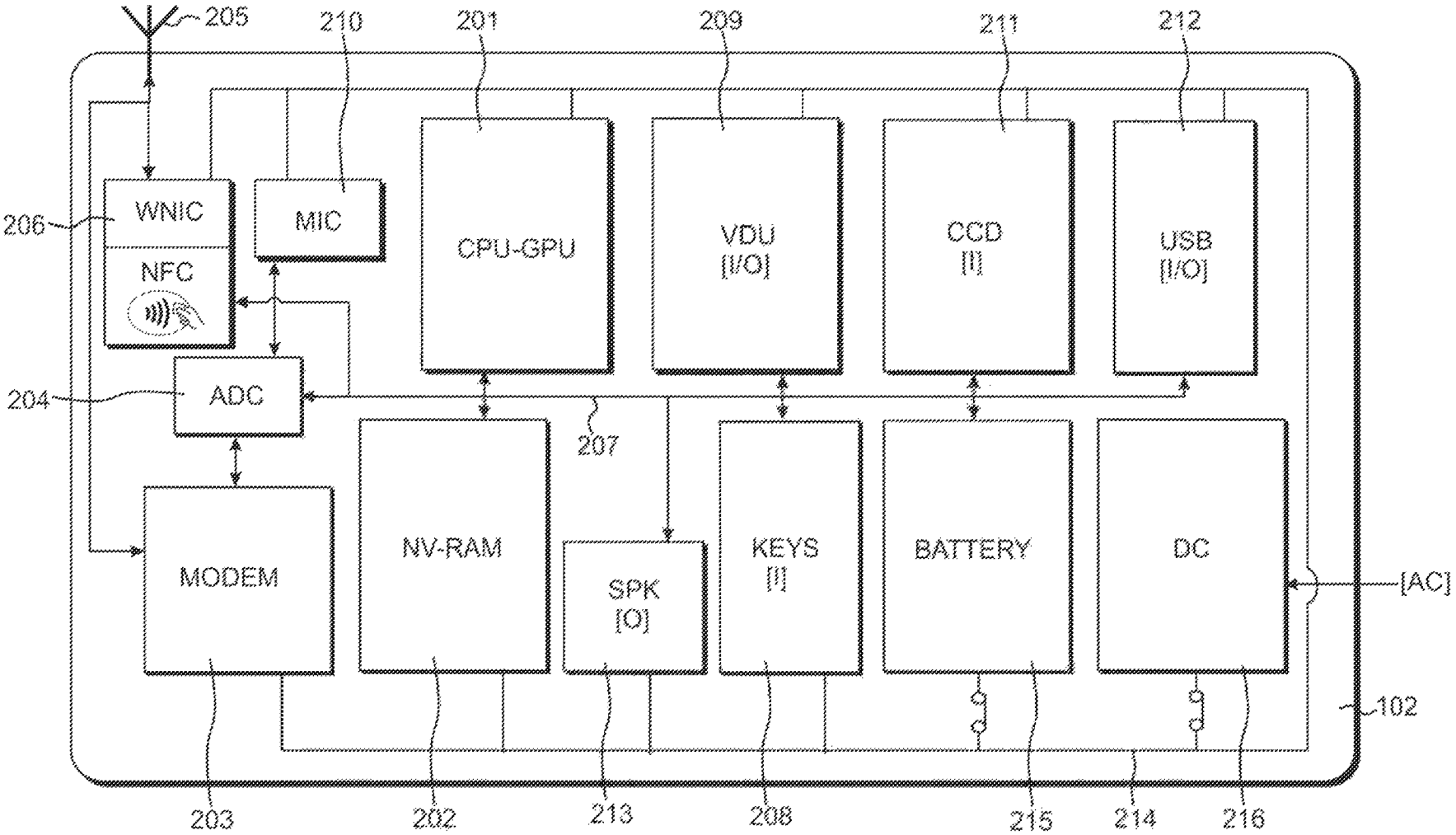
FIG. 2 is a simplified diagram of a typical hardware architecture of a client terminal shown in FIG. 1, including a processor and memory means storing a client set of data processing instructions and a source digital audio signal.
Figure 3:
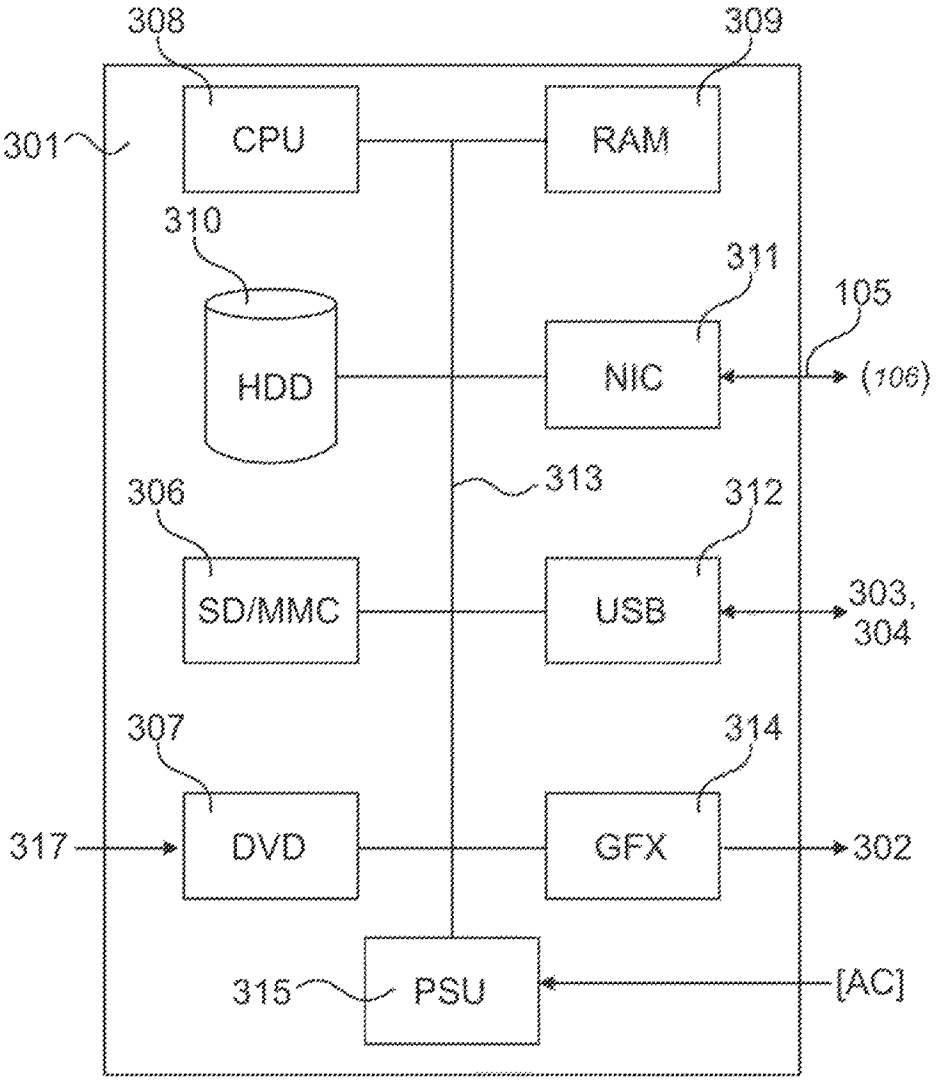
FIG. 3 is a simplified diagram of a typical hardware architecture of a client and/or server terminal shown in FIG.
Figure 3:
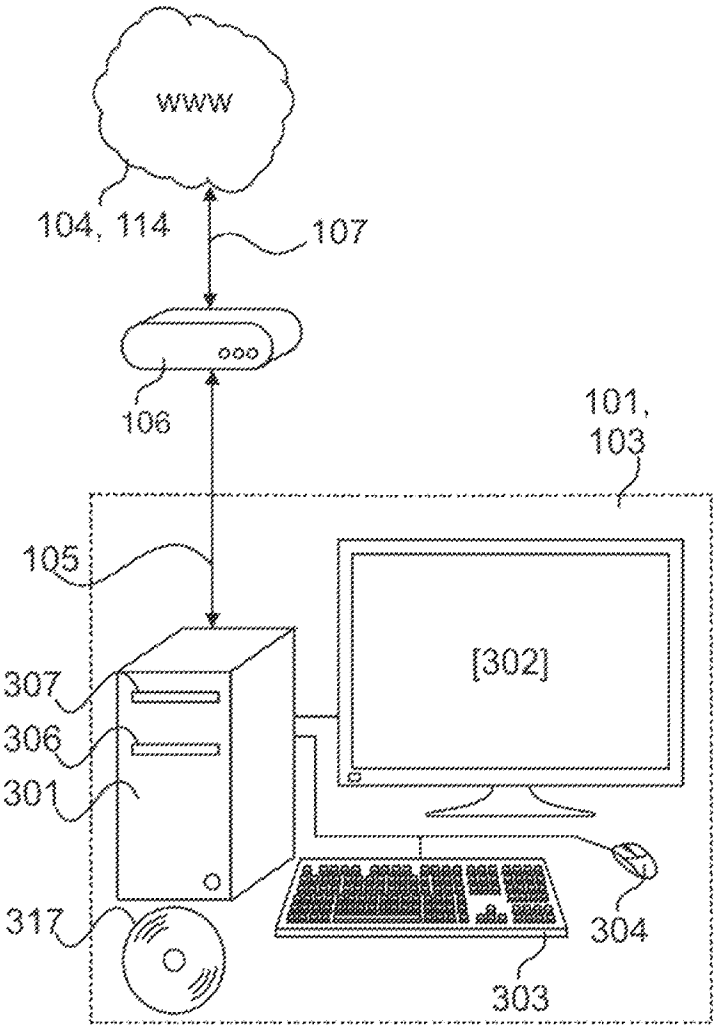
Figure 4:
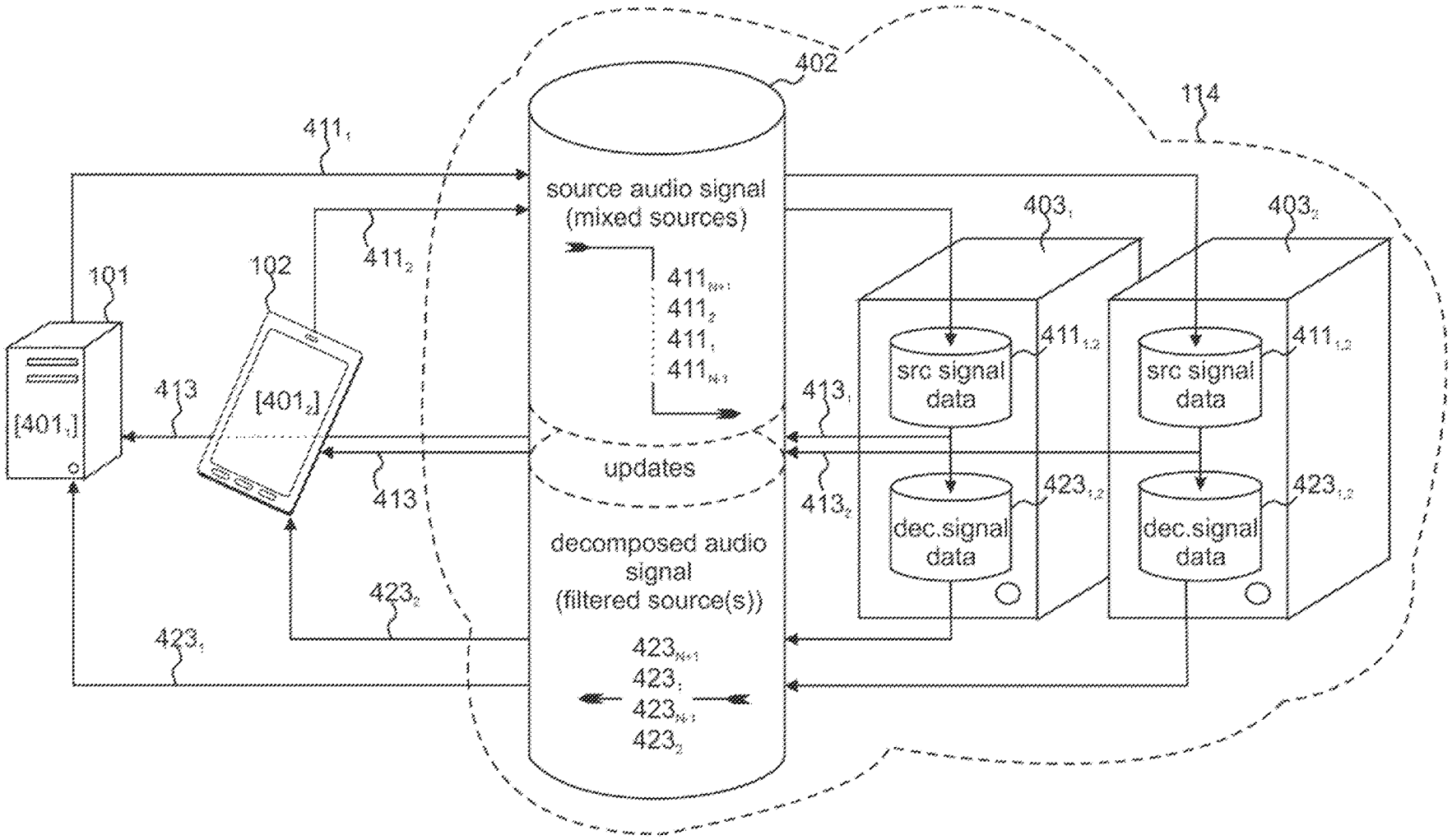

FIG. 4 is a functional diagram of the system shown in FIG. 1 showing the client set of instructions of FIG. 2 in data communication with a remote queuing module and remote instances of a digital audio data processing module embodied by the server set of data processing instructions of FIG. 3.

Figure 5:
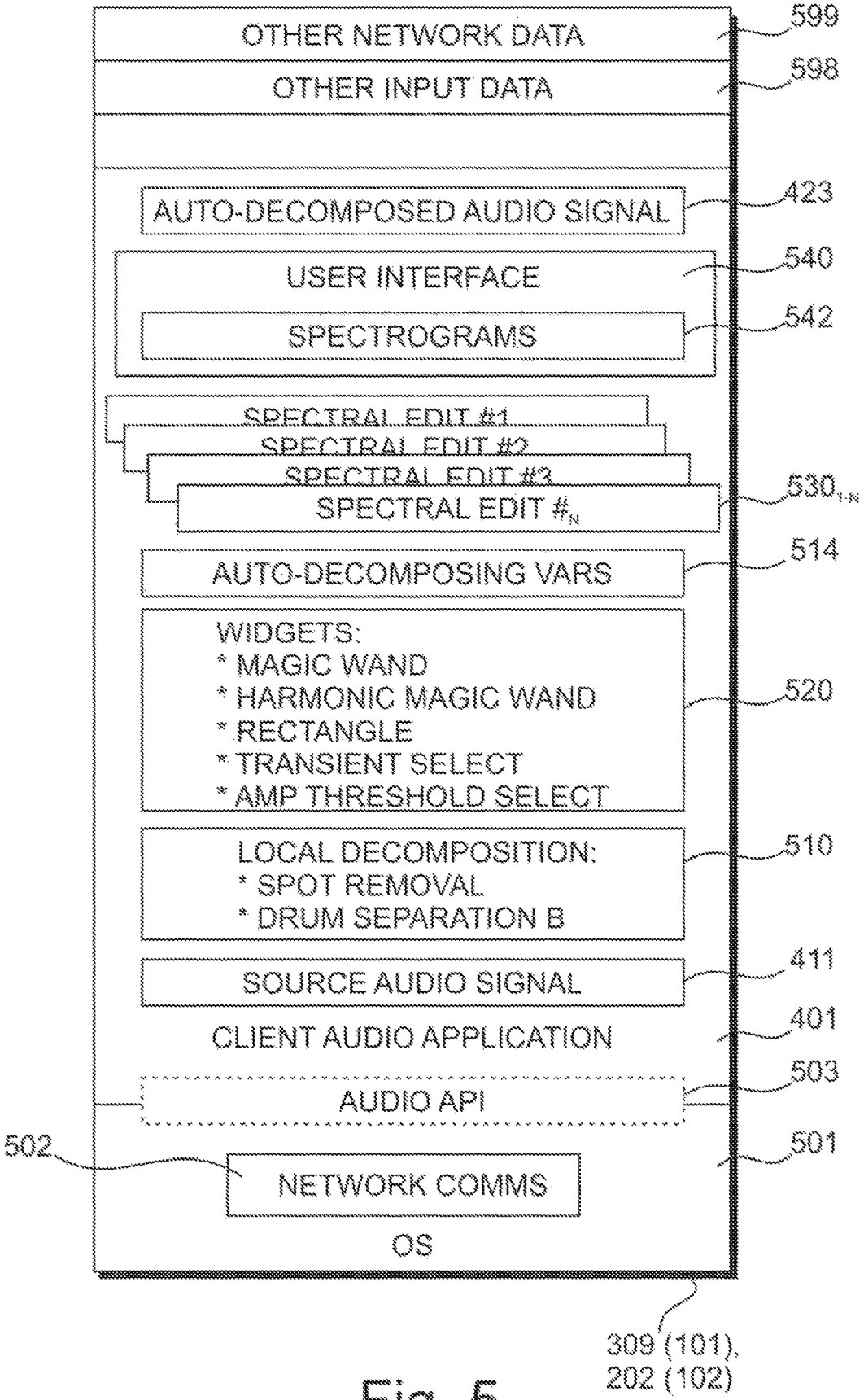

FIG. 5 is a logical diagram of the contents of the memory means of the client terminal shown in FIGS. 1, 2 and 4, including the client set of instructions, a user interface, the source digital audio signal and an output digital audio signal decomposed according to the invention.

Figure 6A:
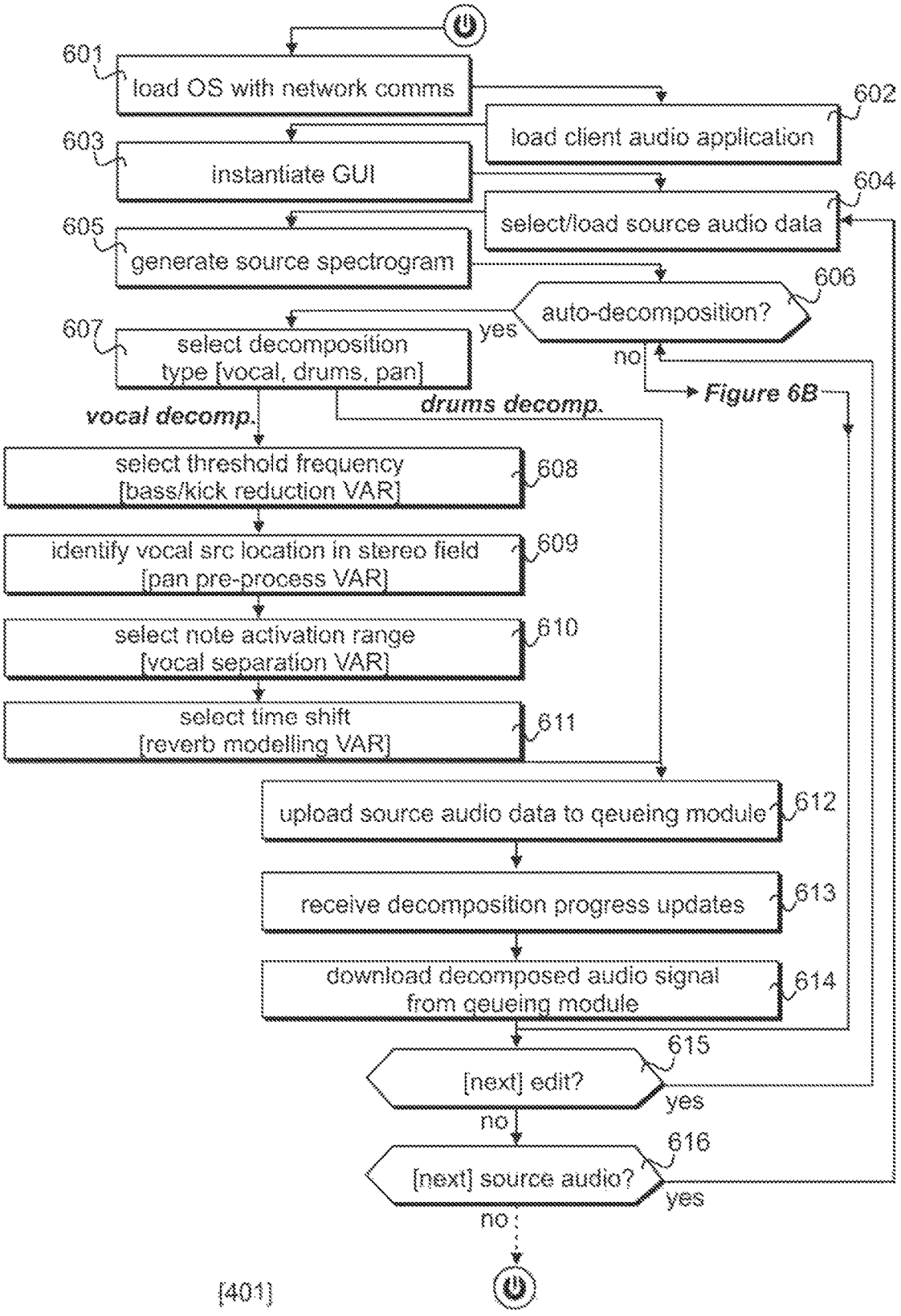

FIG. 6A illustrates steps of a method embodied by the client set of instructions of FIGS. 4 and 5, including steps of uploading the source digital audio signal data to the remote queuing module, selecting a decomposition type and selecting decomposition constraints.

Figure 6B:
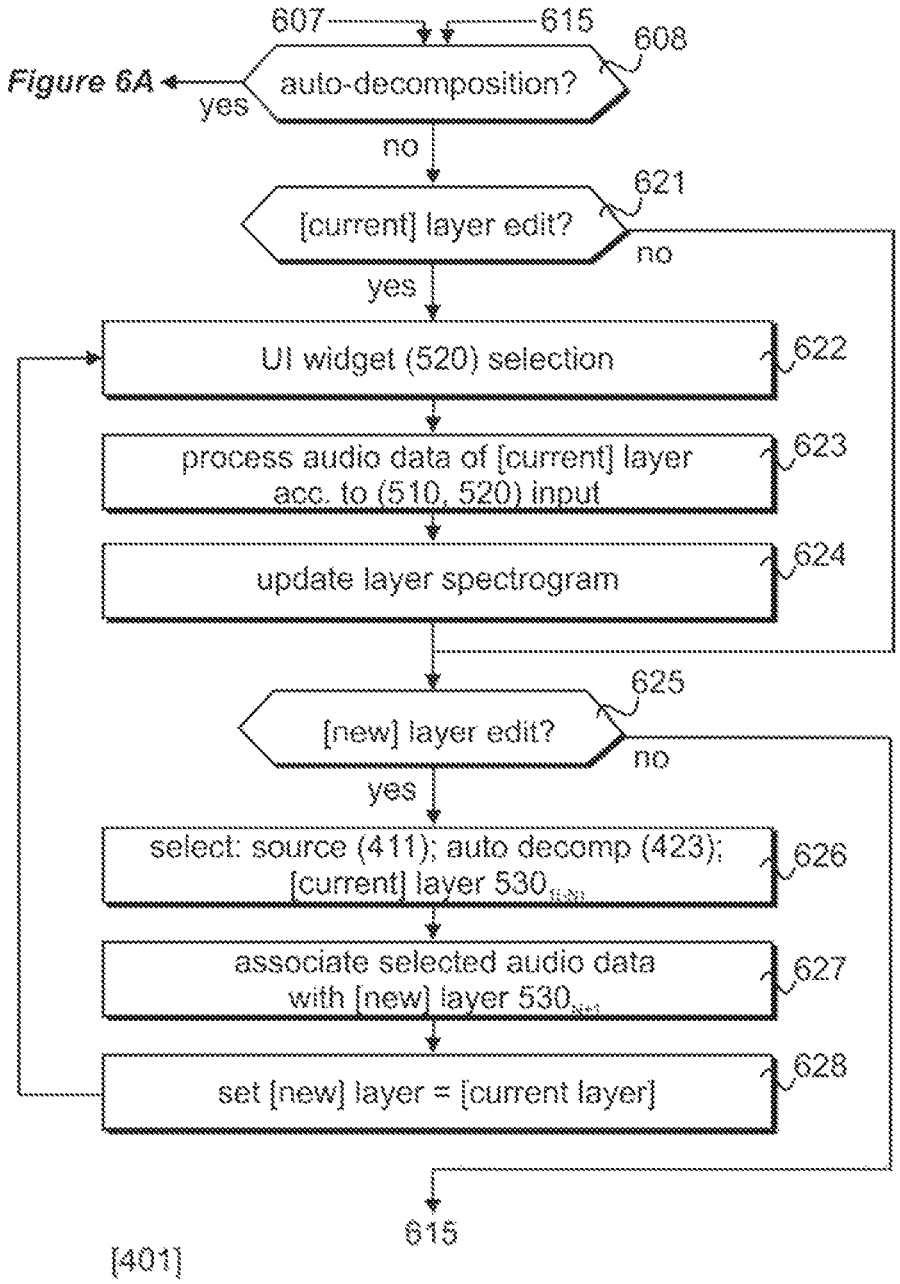

FIG. 6B illustrates sub-steps of the method of FIG. 6B, associated with local spectral editing of a source and/or decomposed digital audio signal.

Figure 7:
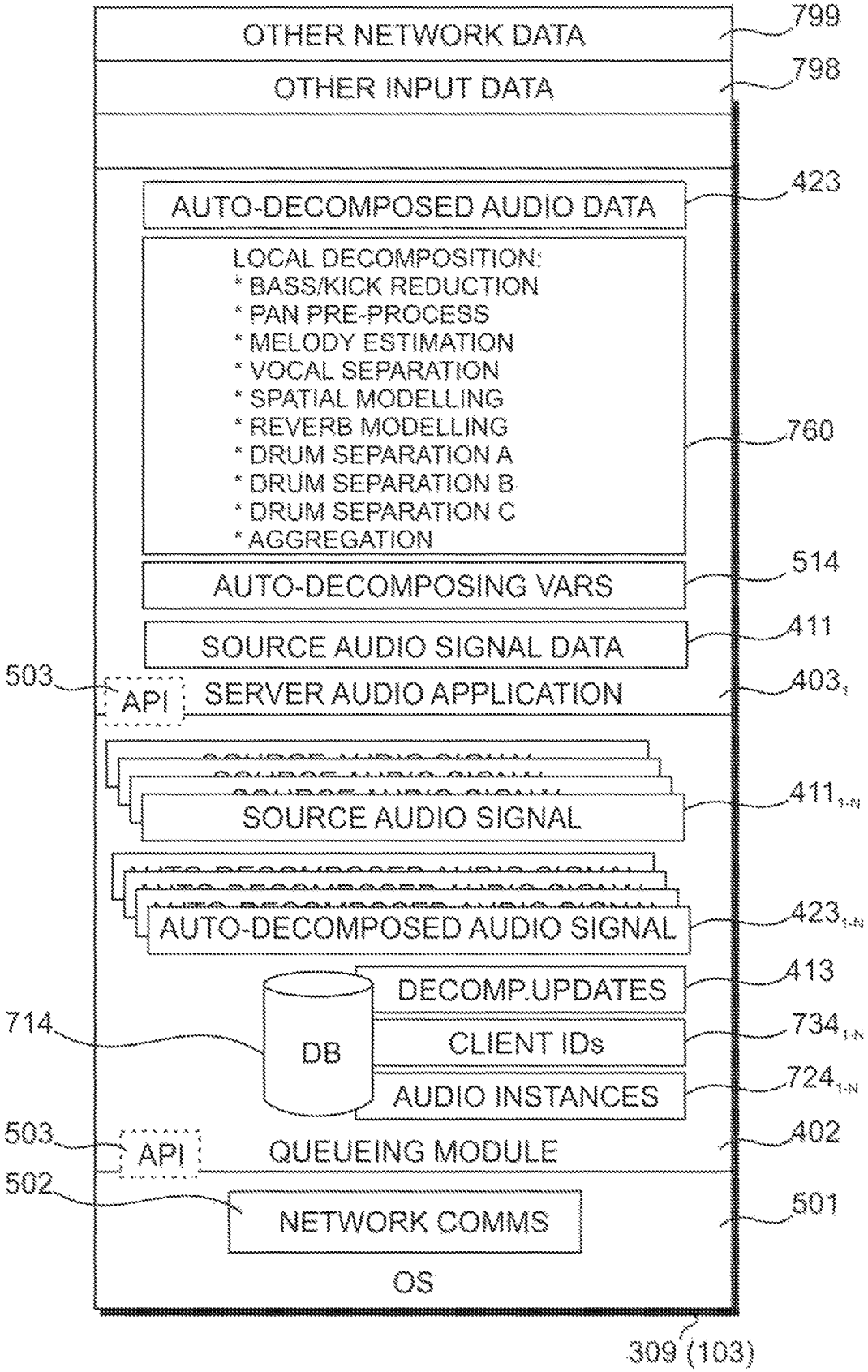

FIG. 7 is a logical diagram of the contents of the memory means of the server terminal shown in FIGS. 1, 3 and 4, including the queuing module and instances of the audio data processing module.

Figure 8:
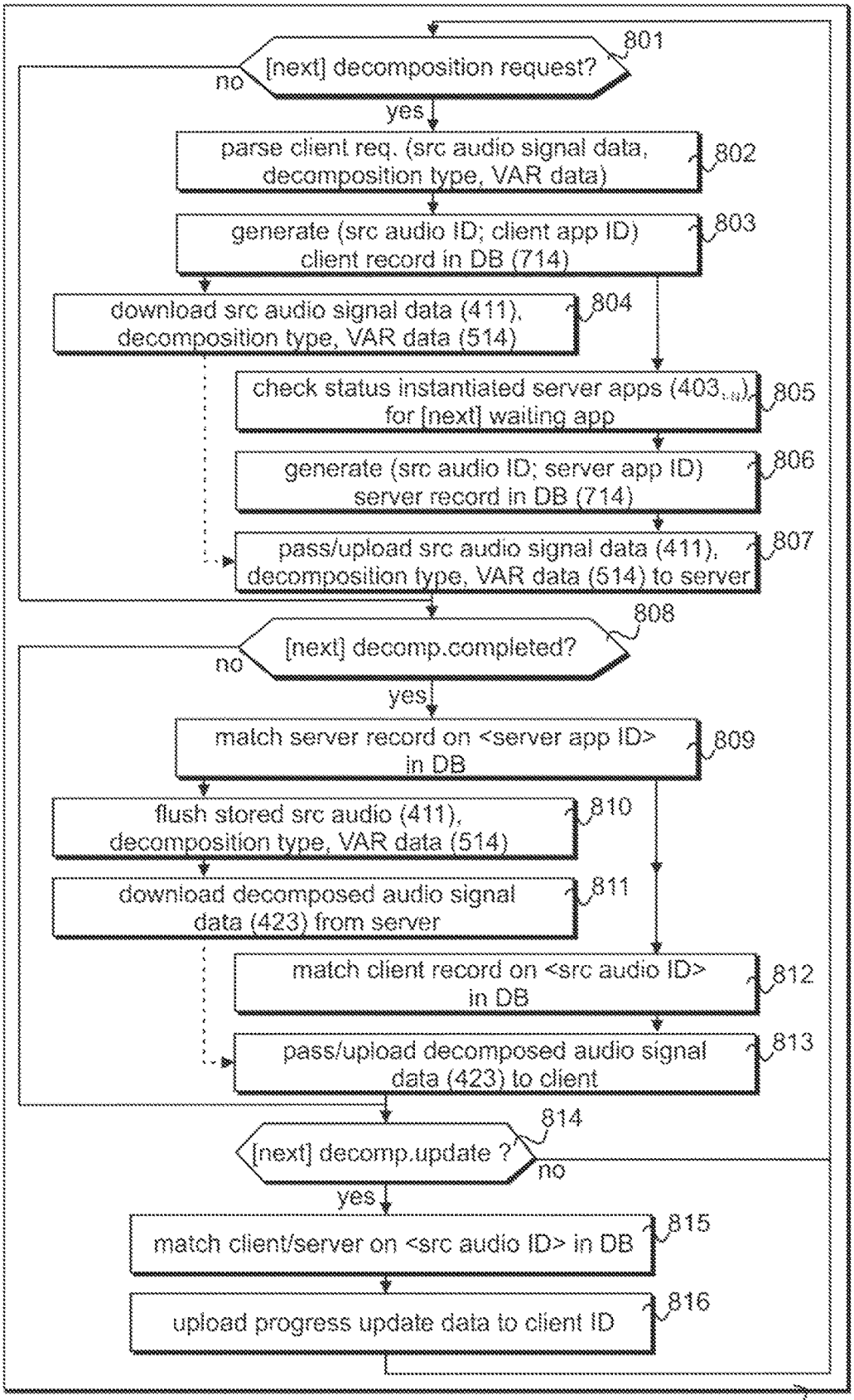

FIG. 8 illustrates steps of a method embodied by the server set of instructions at the queuing module of FIGS. 4 and 7.

Figure 9:
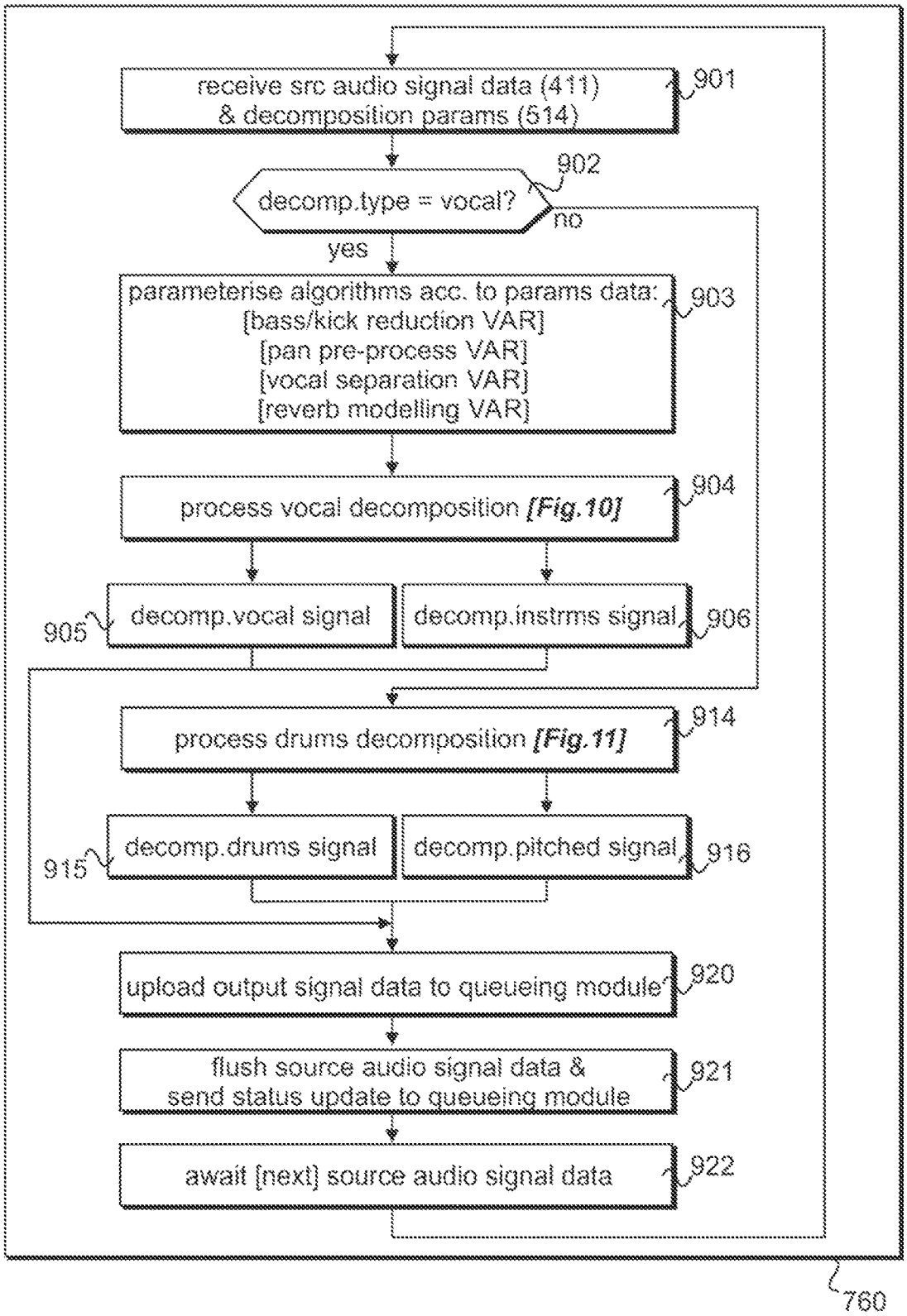

FIG. 9 illustrates steps of a method embodied by the server set of instructions at each instance of the audio data processing module of FIG. 7, including steps of decomposing according to a selected decomposition type and type-dependent constraints.

Figure 10:
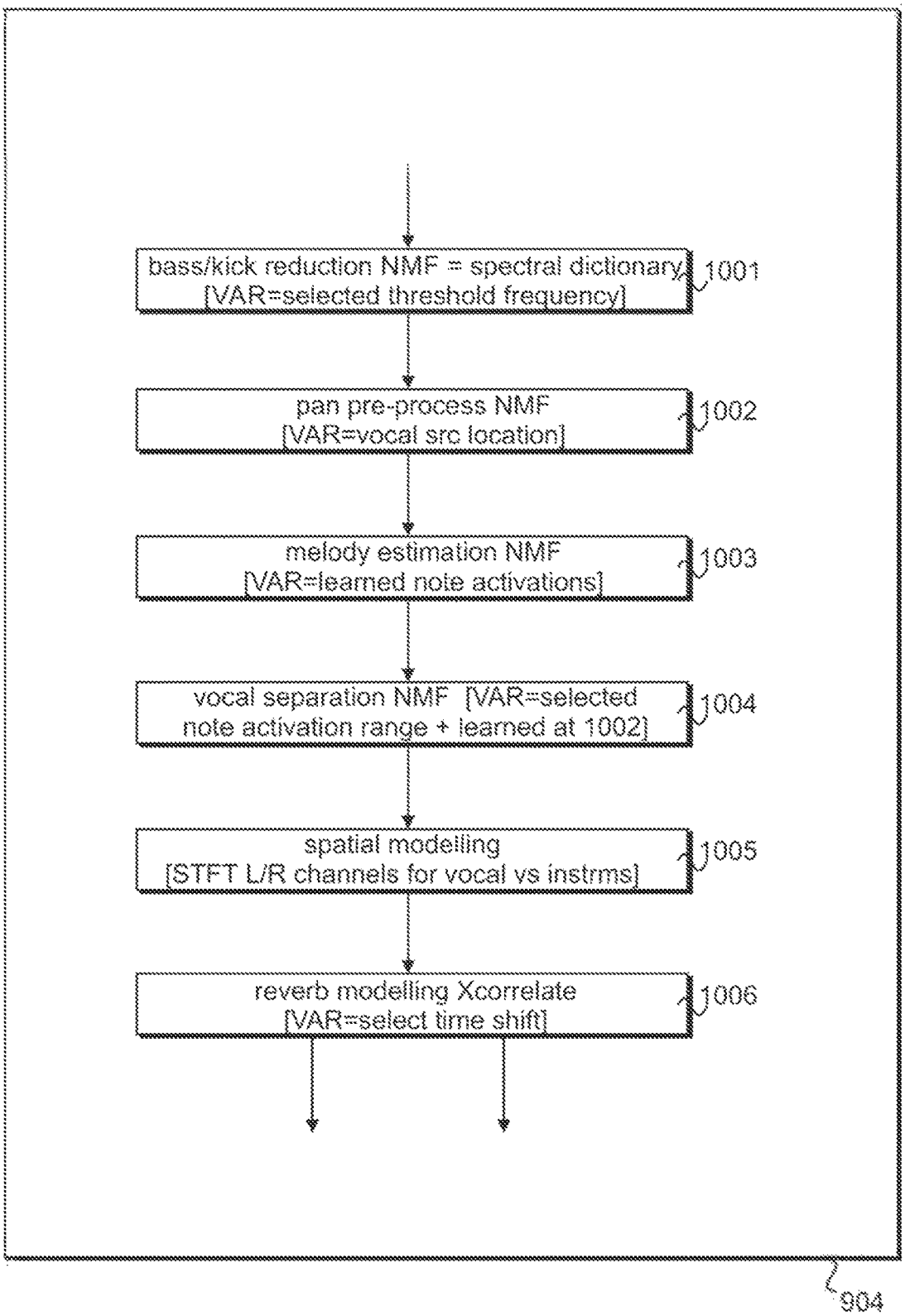

FIG. 10 illustrates sub-steps of a first embodiment of the decomposition step of FIG. 9, for extracting vocal data from the source audio data.

Figure 11:
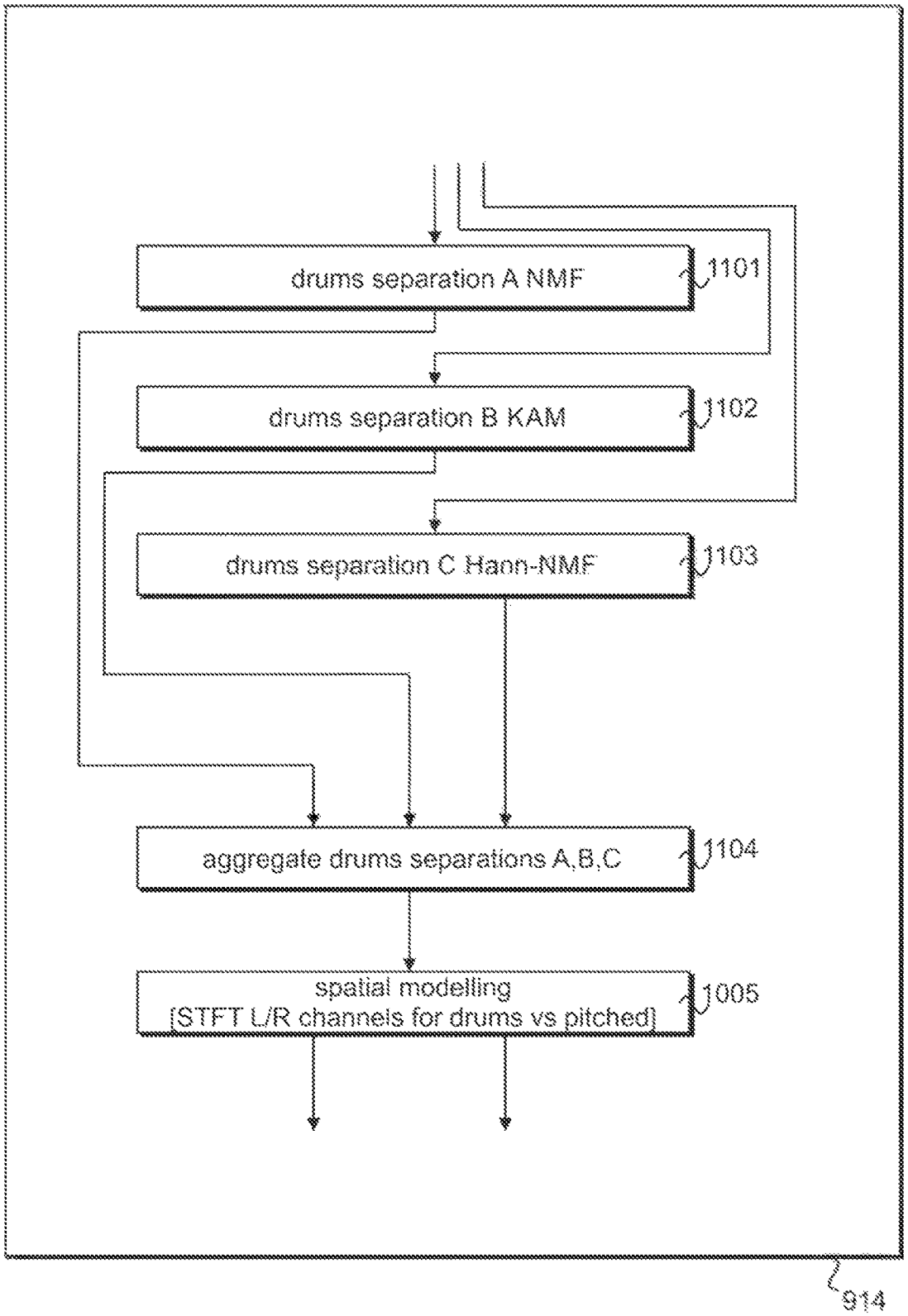

FIG. 11 illustrates sub-steps of a second embodiment of the decomposition step of FIG. 9, for extracting drums data from the source audio data.

DETAILED DESCRIPTION OF THE DRAWINGS

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description. As used herein, the expressions 'audio signal' and 'track' should be understood by the skilled reader as indicating a stereo signal having two channels.

With reference to FIGS. 1 to 4, an example embodiment of a system 100 according to the invention is shown within a networked environment, in which several data processing terminals 101, 102, 103 are connected to a Wide Area Network (WAN) 104, in the example the Internet, through a variety of networking interfaces, wherein network connectivity and interoperable networking protocols of each terminal allow the terminals to connect to one another and to communicate data to, and receive data from, one another according to the methodology described herein.

The system comprises at least one client terminal 101 operated by a user, a first example of which may be a personal computer terminal 101, which is configured to emit and receive data, including audio and/or alphanumerical data, encoded as a digital signal over a wired data transmission 105, wherein said signal is relayed respectively to or from the client terminal 101 by a local router device 106 implementing a wired and/or wireless local network operating according to the IEEE 802.3-2008 Gigabit Ethernet transmission protocol. The router 106 is itself connected to the WAN 104 via a conventional optical fiber connection over a wired telecommunication network 107.

An alternative or additional client terminal is shown at 102 which, in the example, is a portable communication device operated by the same or another user, e.g. a smartphone. The client terminal 102 emits and receives data, including audio and/or alphanumerical data, encoded as a digital signal over a GPRS, 3G or 4G-compliant wireless data transmission 108, wherein the signal is relayed respectively to or from the smartphone 102 by the geographically-closest communication link relay $109_N$ of a plurality thereof. The plurality of communication link relays $109_N$ allows digital signals to be routed between portable devices like the client terminal 102 and their intended recipient by means of a remote gateway 110. The gateway 110 is for instance a communication network switch, which couples digital signal traffic between wireless telecommunication networks, such as the network within which wireless data transmissions 108 take place, and the WAN 104. The gateway 110 further provides layer and communication protocol conversion as required.

The system also comprises at least one server terminal 103. The server terminal 103 is configured to emit and receive data, including audio and/or alphanumerical data, encoded as a digital signal over a wired data transmission 105, wherein said signal is relayed respectively to or from the client terminal 101 by a local router device 106 implementing a wired local network operating according to the IEEE 802.3-2008 Gigabit Ethernet transmission protocol. The router 106 is itself connected to the WAN 104 via a conventional optical fiber connection over a wired telecommunication network 107. In a preferred embodiment shown in FIG. 1, the system comprises a plurality of servers $103_{1\text{-}N}$, across which the data storing and processing tasks described herein with reference to a remote queuing module and a remote audio processing module are shared, and which are presented to any connected client terminal 101, 102 as a unified resource hosted in a 'cloud' 114 portion of the WAN 104. In the example, a further 2 server terminals $103_{2,3}$ are shown connected to the same local router device 106 as the first server terminal 103 for the sake of simplicity, however it will be readily understood by the skilled readers that these 2 servers $103_{2,3}$, and any further server terminals $103_{4\text{-}N}$ added to scale up the system's storage and audio data processing capacity, may all be remote from each other and distinctly connected to the WAN 104.

A typical hardware architecture of the smartphone client terminal 102 is shown in FIG. 2 in further detail, by way of non-limitative example. The smartphone 102 includes a data processing unit 201 such as a general-purpose multi-core microprocessor, for instance conforming to the Snapdragon® architecture designed and marketed by Qualcomm®, acting as the main controller of the client terminal 102 and which is coupled with memory means 202, comprising volatile random-access memory (RAM), non-volatile random-access memory (NVRAM) or a combination thereof.

The user terminal 102 further includes networking means. Communication functionality in the smartphone 102 is provided by a modem 203, which provides the interface to external communication systems, such as the GPRS, 3G or 4G cellular telephone network 108 shown in FIG. 1, associated with or containing an analogue-to-digital converter 204, which receives an analogue waveform signal through an aerial 205 from the communication link relay $\mathbf{109}_N$ and processes same into digital data with the data processing unit 201 or a dedicated signal processing unit. Alternative wireless communication functionality is provided by a wireless network interface card (WNIC) 206 interfacing the smartphone 102 with wireless local area networks (WLAN), for instance generated by a combined wired-wireless router 106. Further alternative wireless communication functionality may be provided by a High Frequency Radio Frequency Identification (RFID) networking interface implementing Near Field Communication (NFC) interoperability and data communication protocols for facilitating wireless data communication over a short distance with correspondingly-equipped devices.

The CPU 201, NVRAM 202 and networking means 203 to 206 are connected by a data input/output bus 207, over which they communicate and to which further components of the smartphone 102 are similarly connected in order to provide wireless communication functionality and receive user interrupts, inputs and configuration data. Accordingly, user input may be received from data input interfaces, which for the smartphone 102 typically comprises a limited number of keys or buttons 208 and/or a capacitive or resistive touch screen feature of the display unit 209. Further input data may be received as analogue sound wave data by a microphone 210, digital image data by a digital camera lens 211 and digital data via a Universal Serial Bus (USB) 212. Processed data is output locally as one or both of display data output to the display unit 209 and audio data output to a speaker unit 213. Power is supplied to the above components by the electrical circuit 214 of the device 102, which is fed by an internal battery module 215 interfaced with a power converter 216 suitable for connection to a local mains power source.

A typical hardware architecture of a desktop computer 101 and a server terminal $\mathbf{103}_{1\text{-}N}$ is shown in FIG. 3 in further detail, by way of non-limitative example. Each data processing terminal 101, 103 is a computer configured with a data processing unit 301, data outputting means such as video display unit (VDU) 302, data inputting means such as HiD devices, commonly a keyboard 303 and a pointing device (mouse) 304, as well as the VDU 302 itself if it is a touch screen display, and data inputting/outputting means such as the wired network connection 105 to the WAN 104 via the router 106, a magnetic data-carrying medium reader/writer 306 and an optical data-carrying medium reader/writer 307.

Within data processing unit 301, a central processing unit (CPU) 308 provides task co-ordination and data processing functionality. Sets of instructions and data for the CPU 308 are stored in random access memory means 309 and a hard disk storage unit 310 facilitates non-volatile storage of the instructions and the data. A network interface card (NIC) 311 provides the interface to the network connection 105. A universal serial bus (USB) input/output interface 312 facilitates connection to the HiD keyboard and pointing devices 303, 304 besides any further USB-compliant external device or component, for example a portable data storage device (not shown).

All of the above components are connected to a data input/output bus 313, to which the magnetic data-carrying medium reader/writer 306 and optical data-carrying medium reader/writer 307 are also connected. A video adapter 314 receives CPU instructions over the bus 313 for outputting processed data to VDU 302. All the components of data processing unit 301 are powered by a power supply unit 315, which receives electrical power from a local mains power source and transforms same according to component ratings and requirements.

As skilled persons will readily understand, in functional terms the respective hardware architectures of the smartphone 102 and the personal computer and server terminals 101, 103 are comparable, with differentiation arising only in respect of the miniaturization, wireless operation and ergonomic handling required for the smartphone 102, relative to components designed for durability and redundancy of operation for the computers 101, 103.

At the client terminal 101, source audio signals encoded on an optical data-carrying medium 317, typically a Compact Disc®, may be read via the optical data-carrying medium reader/writer 307. After converting the source audio signal bitstream read from the disc 317 according to either a lossless encoding format (e.g. Free Lossless Audio Codec, 'FLAC') or a lossy encoding format (e.g. MPEG-1 Layer-3, 'MP3'), source audio signal data may be stored in the HDD 310 as a digital audio signal. Alternatively or additionally, and particularly in the case of the mobile client terminal 102 without optical reading means 307, source audio signals already encoded as lossless or lossy digital audio signal data may be downloaded at the client terminals 101, 102 from a remote resource in the WAN 104 and/or from a local storage device, either in local network connection with the router 106 or in local direct connection via a USB interface 312.

With reference to FIG. 4, the system 100 processes digital audio signals through a distributed data processing architecture comprising a client application $\mathbf{401}_{1\text{-}N}$ stored and processed at each client terminal 101, 102, and server-hosted applications, including at least one queuing module 402 and one or more audio data processing module $\mathbf{403}_{1\text{-}N}$. Each client application $\mathbf{401}_{1\text{-}N}$ allows its user to load source audio signal data 411, to play back loaded source audio signal data 411 and any edited version(s) thereof, to parameterize and request decompositions, i.e. separation of audio sources in a mixed audio signal, and to manually edit loaded source audio signal data 411 and any edited version(s) thereof using a variety of local audio processing functions.

The queuing module 402 is an always-on data processing resource, which is invoked whenever a user requests a remote decomposition at a respective client terminal 101, 102. The queuing module 402 downloads client-respective source audio signal data $\mathbf{411}_{1,2}$ together with decomposition type-dependent parameters from each requesting client terminal 101, 102, and queues same for processing according to the availability of remote audio processing module(s) $\mathbf{403}_{1\text{-}N}$, for instance according to a first-in, first-out buffering principle, variations and optimisations of which may be readily considered based for instance on a source data file size and available client-server network bandwidth.

Each instantiation $\mathbf{403}_{1\text{-}N}$ of the audio data processing module in the cloud 114 is likewise an always-on data processing resource, and so receives source audio signal data $\mathbf{411}_{1,2}$ and decomposition type-dependent parameters from the queuing module 402, then performs automatic separations on the received audio to output decomposed audio signal data $\mathbf{423}_{1,2}$. Each instantiation $\mathbf{403}_{1\text{-}N}$ of the audio data processing module communicates progress updates $\mathbf{413}_{1\text{-}N}$ to the queuing module 402 whilst processing the received source audio data 411; then, upon completing the tasked decomposition, the audio data processing module 403 uploads the decomposed audio signal data $423_{1,2}$ to the queuing module 402 and becomes available for a next decomposition tasking.

The queuing module 402 is thus further invoked whenever a progress update 413 is received from an audio data processing module $403_{1-N}$, which the queuing module 402 relays in real time to the corresponding client terminal 101, 102 at which the ongoing decomposition was requested; and whenever a decomposed audio signal data $423_{1,2}$ is received after its decomposition is completed, which the queuing module 402 uploads to the corresponding client terminal 101, 102 at which the completed decomposition was requested, moreover in real time if the relevant client terminal is network-connected at the material time.

With reference to FIG. 5 now, the contents of the memory means 202, 309 of a client terminal in the data processing context of FIGS. 1 and 4 initially include an operating system 501 which, in the case of desktop client terminal 101, is for instance Windows 10® distributed by Microsoft® of Redmond, Wash. and, in the case of portable client terminal 101, is for instance iOS® distributed by Apple® Inc. of Sunnyvale, Calif. The OS 501 includes communication subroutines 502 to configure the user terminal 101, 102 for bilateral data communication within the networked environment of FIG. 1.

The memory means next includes a local runtime instantiation of a client audio application 401, interfaced with the OS 501 via one or more Application Programmer Interface (API') 503, particularly apt to operably interface the client audio application 401 with each of the client terminal's input, display, audio and networking functionalities. Data used and processed by the client audio application 401 primarily includes locally-loaded source audio signal data 411 and downloaded decomposed audio signal data 423.

The client audio application 401 itself comprises a variety of discrete functional modules, including a variety of local audio data-processing algorithms 510, a variety of audio spectrogram-editing tools or 'widgets' 520, and a user interface 540 in which to both render spectrograms 542 and read user inputs and selections representative of audio editing choices and task-setting, in particular variables 514 for the automatic decomposition of audio signal data 411.

The client application 401 allows the user to load a source audio track 411. Upon completing this loading, the application 401 allows a user to request generation of a spectrogram 542 in the UI 540, which plots how the frequency content of the loaded audio signal changes over time. The editing of audio signals based on spectrograms is known as spectral editing, which is performed both locally through the suite of audio spectrogram-editing tools 520 associated with local audio data-processing algorithms 510, and remotely through the queuing module 402 and instantiations of server audio processing module $403_{1-N}$.

In the UI 540, the user may either edit the source audio signal 411 locally, using the manual editing tools 510, 520, or the user may request one of three types of automatic separations processed remotely at a server 103. The suite of local spectrogram-editing tools 520 comprises known spectrogram-interacting tools, such as "magic wand, "harmonic wand selection", "rectangle selection" and "eraser" selection widgets. The editing tools 520 further comprise a "transient" selecting tool, the function of which is to detect the presence of drum hits in a mixed audio signal, and an "amplitude threshold" selecting tool, the function of which is to select elements in a region of a spectrogram, that are above a given amplitude threshold.

The local audio data-processing algorithms 510 can be applied to these selections for modifying the audio signal in various ways. A "Spot Removal" algorithm performs a local separation on the loaded audio track by detecting similar regions in the signal and then removing parts of the signal that do not repeat between the detected regions. Depending on the input signal 411 and the context of use, this algorithm can be very effective in removing noise or lead instruments from the mixed signal. Another "Drums removal B" algorithm is based on a Kernel Additive Modelling (KAM) framework and incorporates a number of kernels for separating drums and non-drums from the mixed signal.

The client application 401 implements a layers-based principle, wherein any edits whether to the source audio signal 411, to the decomposed audio signal 423 or to an intermediate version of either audio signal, can be exported to a new audio track or layer, for further editing and manipulation in the UI 540. Accordingly a plurality of spectral edits 1 to N are shown at 530 by way of example, wherein the output of one automatic or local separation $530_N$ can be fed into another separation e.g. $530_{N-1}$ or $530_{N+1}$ and wherein these layers e.g. $530_N$, $530_{N+1}$ can also be merged together to create a new composite layer $530_{N+2}$, which combines user-selected elements and edits of the original track 411. Finally, through the API 503 created layers $530_{1-N}$ can be exported as digital audio files encoded in a lossless or lossy format for use in other audio applications.

FIGS. 6A and 6B illustrate steps of the main functionality provided by the client set of instructions 401 as described with reference to FIG. 5, at each user terminal 101, 102. When a user switches their terminal on, the OS 501 is initially loaded with its suite of networking protocols 502 at step 601. The user then loads a runtime instantiation of the client application 401 into the memory 309 at step 602, either from local storage 202, 310, or from a remote resource such as a server terminal 103 across the WAN 104, 114. The client application 401 instantiates its graphical user interface 540 onto the terminal display means at step 603, wherefrom the user may select and locally load a source audio signal 411 at step 604. The client application 401 generates a spectrogram 542 of the loaded source audio signal and outputs same to the GUI 540 at step 605.

A question is then asked at step 606, about whether the user wishes to task a remote server application 403 with automatically decomposing the loaded source audio signal 411. When the question of step 606 is answered positively, the user then selects a decomposition type at step 607, from "vocals", "drums" or "pan": the respective implementations of "vocals" and "drums" decompositions at the server audio processing module 403 attempt to separate these sources from the source audio signal, whilst the implementation of "pan" separates sources based on their position in the stereo field encoded within the source audio signal.

When the user selects a "vocals" decomposition type, the client application 401 requires the user to input decomposition variables 514, namely: a selection of a threshold frequency for the source audio signal as a first decomposition variable at step 608; the identification of a location for the vocal source within the stereo field of the source audio signal as a second decomposition variable at step 609; a selection of a note activation range, for instance of ±1.5 semitones in the source audio signal as a third decomposition variable at step 610; and a selection of a time shift value as a fourth decomposition variable at step 611. When the user selects a "pan" decomposition type, the client application 401 only requires the second variable to be input at step 609. The decomposition variables are then used as constraints on the decomposition algorithms to reduce and refine the possible solutions to the decomposition algorithms. The identification of the vocal position being used to give extra emphasis to notes occurring in this region of the stereo field. The note activation range is used to control how wide a region in frequency is passed surrounding the predominant melody identified in subsequent steps, while the time-shift controls how much reverb is captured by the algorithm.

Upon completing the input of decomposition variables 514, or alternatively when the user selects the third "drums" decomposition type, the client application 401 uploads the source audio data 411, together with any decomposition variables data 514 as input, to the queuing module 402 at step 612. The client application 401 then eventually receives periodical updates at step 613, about the progress of the decomposition processed automatically at a remote server audio application $\mathbf{103}_{1\text{-}N}$. The client application 401 then eventually downloads the decomposed audio signal data 423 from the queuing module 402 at step 614, upon completion of the separating task at the remote server audio application $\mathbf{103}_{1\text{-}N}$.

Alternatively, with reference to FIG. 6B now, when the question of step 606 is answered negatively, the logic proceeds to a further question at step 621, about whether the user wishes to perform a local spectral edit on the spectrogram 542 in the UI 540. When the question of step 621 is answered positively, the client application 401 reads user selection(s) of, and interaction(s) with, a widget 520 in the UI 540 at step 622, then processes the audio data track corresponding to the spectrogram 542 interacted with at step 623.

As the logic described with reference to FIGS. 6A and 6B defines an iterative loop, then the spectrogram 542 interacted with at a first instantiation of step 622 and the corresponding audio data track processed at a first instantiation of step 623 relate to the source audio track 411 loaded at a first instantiation of step 604. Subsequent iterations of steps 622 and 623 may relate to any of the loaded source audio track 411, a downloaded decomposed audio track 423 or an intermediate edited track 530. With reference to FIG. 5, the interaction and processing of steps 622, 623, may in particular result in processing the audio track locally with either of the "spot removal" and/or the "drums removal B" algorithm 510. In any and all cases, at a next step 624 the spectrogram 542 in the GUI 540 is updated according to the output of the processing in the immediately-preceding instantiation of step 623.

Adverting to the description of layers 530 herein, when the question of step 621 is answered negatively however, then a further question is then asked at step 625, about whether the user wishes to associate one or more spectrogram(s) 542, corresponding to respective runtime layer(s) $\mathbf{530}_{1(-N)}$, with a new layer $\mathbf{530}_{N+1}$. When the question of step 625 is answered positively, at step 626 the client application 401 reads a user selection of the one or more spectrogram $\mathbf{542}_{1(-N)}$ in the GUI 540 corresponding to the layer(s) $\mathbf{530}_{1(-N)}$ of interest, and which can correspond to any one or more of the loaded source audio track 411, a downloaded decomposed audio track 423 and an audio track previously edited according to steps 622 to 624. At a next step 627, the client application 401 associates the selected layer(s) $\mathbf{530}_{1(-N)}$ with a new layer $\mathbf{530}_{N+1}$. At step 628, the client application 401 then declares the new layer 530 to be the current runtime layer, upon which further edits, local or remote, shall be performed whence control immediately returns to step 622.

Alternatively, when the question of step 625 is answered negatively, then, returning to FIG. 6A now, a further question is then asked at step 615, about whether the user wishes to perform a further edit on any of the loaded source audio track 411, a downloaded decomposed audio track 423 or an intermediate edited track 530. When the question of step 615 is answered positively, control returns to the first question of step 606, wherein the user may either locally edit any of the loaded source audio track 411, a downloaded decomposed audio track 423 or an intermediate edited track 530 according to steps 621 to 628, or the user may instead task a remote server application 403 with automatically decomposing any of these track types 411, 423, 530.

Alternatively, the question of step 615 is answered negatively and a question is last asked at step 616, about whether the user wishes to select a new source audio signal 411 for editing purposes. When the question of step 616 is answered positively, control returns to step 604 for a suitable selection and loading. Alternatively, the user may wish to interrupt use of the client application 401 and the question is answered negatively, whence its runtime instantiation may eventually be unloaded from memory 202, 309 and the terminal eventually switched off.

Continuing with the description of the system 100, with reference to FIG. 7 now, the contents of the memory means 309 of a server terminal 103 in the data processing context of FIGS. 1 and 4 initially include an operating system 501, which is for instance Windows Server® distributed by Microsoft® of Redmond, Wash. The OS 501 again includes communication subroutines 502 to configure the server terminal 130 for bilateral data communication within the networked environment of FIG. 1.

The memory 309 means next includes the queuing module 402 and, in this embodiment, at least a first instantiation $\mathbf{403}_1$ of the server audio processing module 403, both of which modules are interfaced with the OS 501 via one or more Application Programmer Interface (API') 503, particularly apt to operably interface each module 402, 403 with each other and with the server terminal's input and networking functionalities. It will be readily understood by the skilled person that, subject to scaling of the system 100, other embodiments may have the queuing module 402 distinctly processed at one or more server terminal(s) 103 and instantiations of the server audio processing module 403 at still other server terminal(s) 103, all composing the cloud portion 114 in the WAN 104 that is associated with the system 100.

Data used and processed by the queuing module 402 at runtime includes source audio signal data $\mathbf{411}_{1\text{-}N}$ being downloaded from respective remote client applications $\mathbf{401}_{1\text{-}N}$ pursuant to client step 612, and decomposed audio signal data $\mathbf{423}_{1\text{-}N}$ being downloaded from the or each instantiation $\mathbf{403}_{1\text{-}N}$ of the server audio processing module 403, whether local as illustrated in FIG. 7 and/or remote as illustrated in FIGS. 1 and 4, prior to client step 614.

The queuing module 402 further hosts and processes a data structure 714, such as a database, which references all runtime instantiations $\mathbf{403}_{1\text{-}N}$ of the server audio processing module 403 composing the cloud portion 114 of the WAN 114, in instantiation-respective records $\mathbf{724}_{1\text{-}N}$ that store data representative of an instantiation's network addressing particulars, of source audio data uploaded thereto for decomposition, of decomposed audio data downloaded therefrom, and of decomposition tasking status. The database further references all client applications $\mathbf{401}_{1\text{-}N}$ connected to the system 100 from respective client terminals 101, 102, in client terminal-respective records $\mathbf{734}_{1\text{-}N}$ that store data representative of a client terminal's network addressing particulars, of source audio data downloaded therefrom, and of decomposed audio data uploaded therefrom. The database further references progress updates 413$_{1-N}$ received from server audio processing module instantiations 403$_{1-N}$ and forwarded to respective client applications 401$_{1-N}$ with networking addressing reconciliated from instantiation records 724$_{1-N}$ and client terminal records 734$_{1-N}$.

Data used and processed by the or each instantiation 403$_{1-N}$ of the server audio processing module 403 at runtime includes data representative of a source audio signal 411 and decomposition type data 514 including optionally, in case the tasking is a "vocals" type of decomposition, decomposition variables data, all downloaded from the queuing module 402 pursuant to a tasking. Data output by the or each instantiation 403$_{1-N}$ to the memory 309 includes decomposed audio signal data 423 ready for uploading to the queuing module 402. The or each instantiation 403$_{1-N}$ further comprises decomposing logic 760, comprising a plurality of audio data processing algorithms variously used according to the type of decomposition selected, and further described with reference to FIGS. 10 and 11 herein.

FIG. 8 illustrate steps of the main functionality provided by the queuing module 402 as described with reference to FIGS. 1 to 7, at a server terminal 103. Initially a question is asked at step 801, about whether a decomposition request has been received from a remote client application 401$_{1-N}$ pursuant to step 612. When the question of step 801 is answered positively, the queuing module 402 first validates the request by identifying the source audio data type, the decomposition type requested and the presence of decomposition data associated with a "vocal" decomposition at step 802. At a next step 803, the queuing module generates a client record 734 for the received request in the database 714 to reference the source audio signal 411 and the requesting client application 401 therein. At a next step 804 the queuing module 402 begins to download the source audio data 411 from the requesting client terminal 101, 102.

In parallel with initiating the download step 804, the queuing module 402 checks the instantiations records 724$_{1-N}$ in the database 714 at step 805, for the first instantiation 403 having a decomposition tasking status with a nil value, representative of a server audio data processing module 403 awaiting a next source audio data 411 to decompose. Upon identifying a waiting instantiation, the queuing module 402 then generates a new instantiation record 724 for the received client request in the database 714 at step 806, to reference the downloading source audio signal 411 and the tasked server application 403 therein. At a next step 807 the queuing module 402 begins to upload the source audio data 411 to the tasked server terminal 103.

When completing the uploading or transferring of the source audio data 411 or when the question of step 801 is answered negatively, control proceeds to a second question at step 808, about whether the queuing module 402 has received an indication that a decomposition has been completed at a tasked server audio data processing module 403$_{1-N}$.

When the question of step 808 is answered positively, the queuing module 402 first matches the received indication with the corresponding server record 724 in the database 714 at step 809, then flushes the downloaded source audio data 411, along with its associated decomposition type and parameters data 514, corresponding to the source audio data 411 referenced in the matched server record 724 from local or remote queuing module storage at step 810, before beginning to download the decomposed audio data 423 from the tasked server terminal 103 at step 811.

In parallel with initiating the download step 811, the queuing module 402 matches the flushed downloaded source audio data 411 with the corresponding client record 734 in the database 714 at step 812. Upon establishing a network connection to the matched client terminal 101, 102, at a next step 813 the queuing module 402 begins to upload the decomposed audio data 423 thereto.

When completing the uploading of the decomposed audio data 423 or when the question of step 808 is answered negatively, control proceeds to a third question at step 814, about whether the queuing module 402 has received a progress update 413 from a tasked server audio data processing module 403$_{1-N}$. When the question of step 814 is answered positively, the queuing module 402 matches the tasked server record 724 associated with the received update 412 with the corresponding tasking client record 734 in the database 714 at step 815, then forwards the progress update 413 to the matched client application 401 at step 816. Control then returns to the original question of step 801, likewise when the question of step 814 is answered negatively.

FIG. 9 illustrate steps of the main functionality provided by each server audio data processing module 403$_{1-N}$ as described with reference to FIGS. 1 to 8, at a server terminal 103. At a first step 901, the module 403 receives source audio signal data 411 and decomposition parameterizing data 514 comprising at least data representative of the tasked decomposition type, i.e. "vocal", "drums" or "pan" and, if the tasked decomposition type is "vocal", algorithm constraints data originally input by the user at steps 608 to 611 of the client application 401. A question is next asked at step 902, about whether the tasked decomposition type is indeed "vocal" or not. When the question of step 902 is answered positively, the module 403 constrains each of the parameterisable algorithms 760 in a first sequence thereof, that are involved by the vocal separation data processing and described in further details with reference to FIG. 10, with the received user input 514 at step 903. The module 403 next processes the mixed-source source audio data 411 with the first sequence of algorithms at step 904 to filter the vocal source, and outputs at least the extracted vocal audio track as a first decomposed audio data 423 at step 905. In an alternative embodiment, also shown in FIG. 9, the processing of step 905 further outputs an instrumental audio track omitting the extracted vocal audio track as a second decomposed audio data 423 at step 906.

Alternatively, when the question of step 902 is answered negatively, the module 403 next processes the mixed-source source audio data 411 with a second sequence of algorithms, that are involved by the percussions separation data processing and described in further details with reference to FIG. 11, at step 914. The second sequence of algorithms is designed to filter percussions source(s) from the mixed-sources audio signal data 411, thus the module 403 outputs at least the extracted drums audio track as a first decomposed audio data 423 at step 915. In an alternative embodiment, also shown in FIG. 9, the processing of step 914 further outputs a pitched sources audio track omitting the extracted drums audio track as a second decomposed audio data 423 at step 916.

In another embodiment of the server audio processing module 403 accommodating a "pan" decomposition type (not shown), an intermediary question is asked before step 914, as to whether the tasked decomposition type is "drums" or not and which, when answered positively, proceeds to step 914 but, when answered negatively, causes the module 403 to next process the mixed-source source audio data 411 with a single pan-based audio separation algorithm, described in further details with reference to FIG. 10, and to eventually output two decomposed audio signals 423, one for the strongest audio source in the stereo field and the other for the original mixed-source audio signal omitting the extracted strongest audio source. The pan-based algorithm recovers more than 2 sources, the number can be user-defined but not less than 3, which makes it different from the other separation algorithms. It can be configured with two modes of operation, the first is using a pre-defined set of equally-spaced directions, where the algorithm decomposes the input mixture signal into a set of sources emanating from the pre-defined directions. The second mode of operation is where the user choses the number of directions, and the algorithm learns the directions associated with the user-chosen number of sources. The second mode is considerably more computationally intensive than the first mode, which can operate in less than real-time.

Further to outputting any of the decomposed audio signal data 423 at any of steps 905, 906, 915, 916 and per the alternative embodiment described immediately above, control invariably proceeds to step 920, at which the module 403 sends the indication of completion, then uploads the decomposed audio signal 423 to the queuing module 402. At step 921, the module 403 flushes the source audio data 411 and decomposition data 514 downloaded at the previous instantiation of step 901 from its cache, and sends a status message to the queuing module 402 for updating its decomposition tasking status 734, whence it may then be tasked again by the queuing module 402 in due course. The module 403 thus enters a waiting state at a next step 922, for awaiting a next source audio data signal.

The step 904 of processing the source digital audio signal to extract and output a decomposed vocal track is now described in further detail with reference to in FIG. 10. The main logic of the vocal separation process is based on a non-negative matrix factorisation framework, wherein estimates are generated of the pitches and other events, as well as the time-varying timbres of these events, in the source signal. The predominant or vocal melody in the source audio signal 411 is determined according to these estimates, and used as the basis to generate filters that are then applied to recover the vocal track from the source audio signal 411. How the predominant melody/vocal melody is determined from the estimates of pitches and other events is detailed below. Other events in this case includes the occurrence of non-pitched sounds in the audio mixture, potentially including drums and percussion as well as non-pitched vocal sounds such as consonants, plosives and fricatives. Timbre—the character or quality of a musical sound or voice as distinct from its pitch and intensity. In this case, it can be taken to mean the time-varying frequency content of an event. Once the predominant melody has been estimated, it can then be used to estimate a spectrogram of the vocal melody. This estimate is then used to create a filter, such as a Wiener filter or other suitable type of filter which is then applied to the original complex audio spectrogram before inversion to the time domain audio signal.

A first 'bass/kick reduction' algorithm is applied at step 1001. The input source audio signal 411 is initially filtered to remove everything above the frequency defined by the user with the remote client application 401 at step 608. This frequency is set as high as possible while still ensuring that no significant vocal energy can be heard in the filtered signal. A spectrogram of the remaining signal is then analysed using non-negative matrix factorisation, using a fixed number of basis functions to learn a spectral dictionary and the time-activations associated with the spectral dictionary. A spectrogram of the full input signal is then obtained, and a constrained non-negative matrix factorisation is then performed on that second spectrogram, recovering a second spectral dictionary and their associated time activations. A subset of the recovered dictionary is forced to have the same time activations as those learned from the previous step. This allows recovery and removal through filtering, of higher-frequency energy which is primarily associated with events that have their main energy below the user-defined frequency from the previous step. The vocal signal is thus easier to identify and recover in the remaining signal, by generating two distinct signals which respectively contain drums and non-drum elements.

A second 'pan-based separation' algorithm is next applied at step 1002. This algorithm is based on the assumption that the lead vocal source usually has its energy coming from a specific position in the stereo field. The algorithm incorporates a spatial model into a non-negative matrix factorisation framework, which allows separation of sources in stereo signals based on their direction in the stereo field, wherein the position of the lead vocal source in the stereo field is identified by the user with the remote client application 401 at step 609. The source audio signal data 411 is thus processed to filter out energy, which is not coming from the spatial region associated by the user with the vocal source.

Having removed low-frequency energy and energy coming from directions not associated with the vocal source from the source audio signal data 411 at steps 1001 and 1002 respectively, a third 'melody estimation' algorithm is next applied at step 1003. This algorithm initially generates a variable Q spectrogram of the source audio signal data 411, which is then factorised using a shift-invariant non-negative matrix factorisation, wherein pitched notes are constrained to have harmonic patterns. These patterns are created through time-varying weighted combinations of harmonic templates, the weights of which are learned during the factorisation process. These weighted harmonic templates are convolved with note activations, which are also learned during the factorisation process, to estimate a model of the variable Q spectrogram. Non-harmonic information is modelled using standard non-negative matrix factorisation. Once a sufficient number of iterations has been performed, the note activations are analysed using an algorithm similar to the Viterbi algorithm, to determine the predominant pitch or melody in the signal, which typically will be the lead vocal source or another solo instrument in the mixed audio signal. The note activation functions can be randomly initialised and then these estimates are updated in an iterative manner using a suitable cost function such as the generalised Kullback-Liebler divergence as a measure of fit between the original spectrogram and that estimated by the decomposition process. Once the iterative algorithm has converged, a variant on the Viterbi algorithm can be used to identify the predominant melody from the note activation functions. This path is determined from the amplitudes of the note activation functions, in conjunction with constraints on the likelihood of large jumps in the pitch of the predominant melody, as well as a constraint which encourages the temporal continuity of the predominant melody.

Once the predominant melody has been determined at step 1003, a fourth 'vocal separation' algorithm is next applied at step 1004. Substantially the same factorisation process as used for the melody estimation of step 1003 is repeated, however wherein all note activations of the predominant melody, that are outside the range (of typically plus or minus 1.5 semitones) defined by the user with the remote client application 401 at step 610, at a given time frame are set to zero. A standard non-negative matrix factorisation is used to model all non-melody notes and events, which results in two estimated spectrograms, one for vocals audio data and one for backing track audio data. These estimated spectrograms are then used to filter the variable Q spectrogram before inversion of the separated vocal and backing track signals to the time domain.

The resulting vocal and backing track signals recovered after step 1004 typically have artefacts and noise present. Some of these artefacts are as a result of inconsistencies in how the vocal signal and/or the backing track has been modelled in the individual channels of the signal. In order to at least reduce, and optimally remove, these artefacts, a fifth 'spatial modelling' algorithm is next applied at step 1005. In this algorithm, the vocals and backing track signals separated at step 1004 are transformed to the time-frequency domain using a short-time Fourier transform (STFT), and spatial modelling is performed to identify a coherent stereo model for the lead vocal and a distinct coherent stereo model for the backing track. This is done by taking the STFT of each channel in the vocal signal and projecting them against each other in a number of different directions, so that phase cancellation occurs.

The resulting projections are aggregated into a tensor, and the tensor is factorised to yield a single spectrogram which best fits the vocal signal, and a spatial direction activation vector, which describes in which direction the estimated spectrogram is coming from in the spatial, stereo field. The backing track then undergoes the same processing method, whereby coherent spatial models obtained are then used to filter the source audio data signal 411, leading to recovered vocal and backing tracks 905, 906 that contain less artefacts than was obtained at the end of stage 1004. The tensor can be factorised using a non-negative matrix factorisation approach. The tensor is of size $F \times T \times P$ where F is the number of frequency bins, T is the number of time frames, and P is the number of projections. This is flattened to a matrix of size $(F \times T) \times P$. This matrix is then factorized as $X=AS$, where A is a vector of size $(F \times T)$ containing a flattened spectrogram for the source, and S is a spatial activation vector of size $1 \times P$. Both A and S are randomly initialised and iteratively updated using a suitable cost function such as the generalised Kullback-Leibler divergence in the manner of standard non-negative matrix factorisation algorithms. Once the factorisation is completed A is then reshaped to a single spectrogram of size $F \times T$. The estimated single source spectrogram and associated spatial activation vector can then be used to construct a new estimate of the source tensor. This process is performed for the vocal tensor and the backing track tensor. These new estimates are then used to create a suitable filter such as a Wiener filter which is applied to the original audio mixture.

Steps 1003, 1004 and 1005 assume that the vocal energy primarily comes from a single direction in the stereo field. While this is usually the case, artificial reverberation is typically added during the mixing process to add a sense of space to the recordings. It is quite common that this reverb will come from a different direction to that of the original vocal, and so is not captured by the algorithms described above. To compensate for this, a sixth 'reverb modelling' algorithm is applied at step 1006.

In this algorithm the spectrogram of the vocal signal is cross-correlated with a spectrogram of the backing track signal. This cross-correlation is performed up to a time shift value defined by the user with the remote client application 401 at step 611, and the correlation coefficients obtained are used to identify the strength of the vocal reverb remaining in the backing track. Shifted versions of the vocal spectrogram, scaled in accordance with the correlation coefficients, are then added to the original vocal spectrogram to create an improved vocal spectrogram. This improved vocal spectrogram and the backing track spectrogram are then used to filter the source audio signal data 411, yielding an improved vocal signal containing the vocal reverb. The incorporation of the vocal reverb also has the effect of masking many of the remaining artefacts in the separated vocal signal, resulting in a decomposed vocal audio data 423 with high audio quality. The separately-decomposed backing track audio data also has considerably less lead vocal source data remaining therein.

In an alternative embodiment of the system 100, the client application 401 may provide its user with the ability to select the exporting of the vocal reverb audio data determined at step 1006, separately from the decomposed vocal audio data 423 and from the decomposed backing track audio data, wherein this selection is input as further parameterisation decomposition variable 514.

The step 914 of processing the source digital audio signal to extract and output a decomposed percussions or 'drums' track is now described in further detail with reference to in FIG. 11. This logic is again based around a non-negative matrix factorisation framework, and incorporates a number of constraints in time and frequency on the factorisation, in order to generate two distinct signals which respectively contain drum and non-drum audio sources.

The 'drum' decomposition logic initially relies upon three distinct 'drums' separation algorithms, the respective outputs of which are then aggregated in a specific manner. Each 'drums separation' algorithm generates a spectrogram of the source audio signal data 411 via a respective Short-Time Fourier Transform, and generates estimated spectrograms of the separated drums audio sources, i.e. percussion instruments, and pitched audio sources, i.e. musical instruments.

Accordingly, the source audio signal 411 downloaded from the queuing module 402 is input in parallel to the first 'drums separation A' algorithm at step 1101, to the second 'drums separation B' algorithm at step 1102 and to the third 'drums separation C' algorithm at step 1103.

The first 'drums separation A' algorithm of step 1101 is a non-negative matrix factorisation-based algorithm, with additional constraints on the spectral dictionaries to be learned and the time-activations to be learned. For the drum basis functions, the constraints force the algorithm to learn smooth spectral dictionary elements, and transient-like time-activations, to reflect the fact that percussions are broadband noise, whereas their occurrences are transient in nature. Conversely, for pitched instruments in the source audio data 411, the spectral dictionary is forced to be spiked or sparse in nature, whilst the time-activations are constrained to be smooth, reflecting the fact that most notes by pitched instrument are sustained. Whereas factorisation is usually performed either using a linear spectrogram or a log-frequency spectrogram, in this algorithm the mapping from the linear domain to the log-frequency domain is incorporated into the algorithm, so that reconstruction accuracy of the factorisation is measured in the linear domain, whereas the constraints are simultaneously enforced in the log-frequency domain. This technique provides improved results as regards removing vocal source interference from the drum audio signal. In this case, dictionary spectral smoothness is imposed by adding a continuity constraint to ensure that the difference between two adjacent frequency bins is not too large, while still trying to ensure a good fit between the actual source spectrogram and the estimated spectrogram. Transient-like time activations are learned by imposing a constraint that the difference between successive time activations is as large as possible while still trying to ensure a good fit between the actual source spectrogram and the estimated spectrogram.

The second 'drums separation B' algorithm of step 1102, which is also incorporated in the client application 401 as a local audio processing tool 510, is based on a Kernel Additive Modelling framework and is a fast drum separation algorithm implementing the principle that drums can be regarded as vertical ridges in spectrograms, whereas pitched instruments can be regarded as horizontal ridges. This is achieved by choosing a suitable kernel for the kernel additive modelling framework. For example a kernel of Fk×1 where Fk is the number of frequency bins in the kernel (Fk=17 for example) and 1 is the number of time frames, encourages structures which have continuity in frequency, or in other words, a vertical ridge in the spectrogram. Similarly a kernel of size 1×Tb where 1 is the number of frequency bins in the kernel and Tb is the number of time frames in the kernel (for example Tb=17) encourages structures which have continuity in frequency, or in other words a horizontal ridge in the spectrogram.

The third 'drums separation C' algorithm of step 1103 enforces smoothness of the drum basis functions, by restricting them to be composed of sums of Hann windows of 1 octave width in frequency, and then performing non-negative matrix factorisation using this dictionary.

The drum spectrograms respectively output by each of the A, B and C drums algorithms are then combined at step 1104, by taking the elementwise median of the spectrograms. The process is repeated for the pitched instruments signal. The resulting drum and pitched spectrograms are then further improved by a further median filtering stage, wherein the output of the first 'drums separation A' algorithm of step 1001 are replaced by the results from the first median filtering stage, and median filtering is again performed across all three A, B and C drums algorithms.

The resulting drums signal and pitched instrument signal recovered after step 1005 typically still have artefacts and noise present. Some of these artefacts are as a result of inconsistencies in how the drums signal and/or the pitched instrument track has been modelled in the individual channels of the signal. In order to reduce and remove these artefacts, the decomposed signals are transformed to the time-frequency domain using a short-time Fourier transform (STFT), then processed with the same 'spatial modelling' algorithm of 'vocal' separation step 1005 to identify a coherent stereo model for the drums signal and a separate coherent stereo model for the pitched instruments signal. This approach results in a decomposed drums audio data 423 with high audio quality. The separately-decomposed backing track audio data also has considerably less percussions source data remaining therein. The present invention thus provides a distributed audio editing system 100 apt to automatically decompose audio mixtures 411 into audio signals with discrete audio source(s) 423 at comparatively little data storage and processing expense for a client terminal 101, 102. The system of the invention is relevant to a wide variety of audio data processing contexts involving variously the music industry, post-production in the broadcast and film industries, as well as others such as audio forensics. The system of the invention may find ready applications such as the mixing and remixing of archival material, music repurposing, content generation such as instrumental backing tracks, upmixing of stereo tracks to surround sound formats, de-noising and repair of flawed recordings, the elimination unwanted sounds in recordings, the removal of spill or bleed from adjacent instruments which have been recorded in a live setting, besides generally allowing increased creativity in musical composition and sound design.

In the specification the terms "comprise, comprises, comprised and comprising" or any variation thereof and the terms include, includes, included and including" or any variation thereof are considered to be totally interchangeable and they should all be afforded the widest possible interpretation and vice versa. The invention is not limited to the embodiments hereinbefore described but may be varied in both construction and detail.

What is claimed is:

1. A distributed system for decomposing audio signals including mixed audio sources, comprising:

at least one client terminal, at least one remote queuing module, and at least one remote audio data processing module connected in a network, wherein each client terminal of said at least one client terminal is programmed to store source audio signal data, select at least one signal decomposition type, upload the source audio signal data with data representative of the at least one signal decomposition type that is selected to the at least one remote queuing module, and download decomposed audio signal data;

each queuing module of the at least one remote queuing module is programmed to queue the source audio signal data that is uploaded and distribute the source audio signal data that is uploaded to the at least one remote audio data processing module, and queue the decomposed audio signal data that is downloaded and distribute the decomposed audio signal data that is downloaded to the each client terminal; and each audio data processing module of the at least one remote audio data processing module is programmed to process the source audio signal data that is distributed into decomposed audio signal data according to the at least one signal decomposition type that is selected, and upload the decomposed audio signal data to the at least one remote queuing module;

wherein each remote audio data processing module of the at least one remote audio data processing module processes distributed source audio data for separating at least a vocal audio source therefrom, with a first sequence of algorithms implementing non-negative matrix factorizations, and wherein each client terminal is further programmed to constrain one or more algorithms of the first sequence of algorithms with respective variables encoded in the data representative of the at least one signal decomposition type that is selected.

2. The distributed system of claim 1, wherein the at least one signal decomposition type comprises at least one selected from a vocal audio source separation and a drums audio source separation.

3. The distributed system of claim 1, wherein the at least one signal decomposition type further comprises a separation of an audio source location within the source audio signal data.

4. The distributed system of claim 1, wherein each remote audio data processing module of the at least one remote audio data processing module processes the distributed source audio data for separating at least a drums audio source therefrom, with a second sequence of algorithms implementing non-negative matrix factorizations.

5. The distributed system of claim 4, wherein at least one algorithm of the second sequence of algorithms implements at least one Kernel Additive Modelling (KAM) algorithm for processing the distributed source audio signal data.

6. The distributed system of claim 1, wherein each client terminal is further programmed to locally process the stored source audio signal data with one or more locally-stored decomposition algorithms into edited audio signal data.

7. The distributed system of claim 5, wherein the at least one KAM algorithm of the second sequence of algorithms is a locally-stored decomposition algorithm.

8. The distributed system of claim 1, wherein said each client terminal is further programmed to combine any one or more of the source audio signal data that is stored, the decomposed audio signal data that is downloaded and edited audio signal data into a new audio signal.

9. A computer-implemented method for decomposing a digital audio signal including mixed audio sources in a network, comprising:

selecting a source audio signal data and selecting a decomposition type at a client terminal;

uploading the source audio signal data and data representative of the decomposition type that is selected to a queuing module;

queuing the source audio signal data that is uploaded and distributing to the source audio signal data that is uploaded to an audio data processing module from the queuing module;

processing the source audio signal data that is distributed into decomposed audio signal data at the audio data processing module with a sequence of algorithms implementing non-negative matrix factorizations, wherein the sequence of algorithms is determined by the decomposition type that is selected, uploading the decomposed audio signal data to the queuing module; and queuing the decomposed audio signal data that is uploaded and distributing the decomposed audio signal data that is uploaded to the client terminal from the queuing module.

10. The computer-implemented method of claim 9, wherein the step of selecting the decomposition type comprises selecting at least one selected from a vocal audio source separation and a drums audio source separation.

11. The computer-implemented method of claim 9, wherein the processing the source audio signal data that is distributed comprises separating at least a vocal audio source therefrom, with a first sequence of algorithms implementing said non-negative matrix factorizations.

12. The computer-implemented method of claim 9, wherein the processing the source audio signal data that is distributed comprises separating at least a drums audio source therefrom, with a second sequence of algorithms implementing said non-negative matrix factorizations.

13. A set of instructions recorded on a non-transitory data carrying medium or stored at a non-transitory network storage medium which, when read and processed by a data processing terminal connected to a network, configures the data processing terminal to perform a computer-implemented method for decomposing a digital audio signal including mixed audio sources in the network, the computer-implemented method comprising:

selecting a source audio signal data and selecting a decomposition type at a client terminal;

uploading the source audio signal data and data representative of the decomposition type that is selected to a queuing module;

queuing the source audio signal data that is uploaded and distributing to the source audio signal data that is uploaded to an audio data processing module from the queuing module;

processing the source audio signal data that is distributed into decomposed audio signal data at the audio data processing module with a sequence of algorithms implementing non-negative matrix factorizations, wherein the sequence of algorithms is determined by the decomposition type that is selected, uploading the decomposed audio signal data to the queuing module; and queuing the decomposed audio signal data that is uploaded and distributing the decomposed audio signal data that is uploaded to the client terminal from the queuing module.

* * * * *